US008602512B2

(12) United States Patent
Furukawa et al.

(10) Patent No.: US 8,602,512 B2
(45) Date of Patent: Dec. 10, 2013

(54) LIQUID SUPPLYING APPARATUS, LIQUID EJECTING APPARATUS AND PRESSURE CONTROL METHOD

(75) Inventors: Koji Furukawa, Kanagawa-ken (JP); Jun Isozaki, Ebina (JP); Masaki Kataoka, Ebina (JP)

(73) Assignees: FUJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 131 days.

(21) Appl. No.: 13/194,025

(22) Filed: Jul. 29, 2011

(65) Prior Publication Data

US 2012/0024395 A1 Feb. 2, 2012

(30) Foreign Application Priority Data

Jul. 30, 2010 (JP) ..... 2010-172785

(51) Int. Cl.
*B41J 29/38* (2006.01)

(52) U.S. Cl.
USPC ..... 347/6; 347/5; 347/7

(58) Field of Classification Search
USPC ..... 347/6, 7, 9, 5
See application file for complete search history.

(56) References Cited

U.S. PATENT DOCUMENTS

2008/0007579 A1* 1/2008 Furukawa et al. ..... 347/6
2008/0218563 A1 9/2008 Okumura

FOREIGN PATENT DOCUMENTS

JP 2000-229422 A 8/2000
JP 2008-247021 A 10/2008

* cited by examiner

*Primary Examiner* — Lam S Nguyen

(74) *Attorney, Agent, or Firm* — Birch, Stewart, Kolasch & Birch, LLP

(57) ABSTRACT

A liquid supplying apparatus includes: a first flow channel configured to be switchable between a state of communication with a liquid supply object and a state of noncommunication with the liquid supply object; a first pressure applying device which applies pressure to liquid in the first flow channel; a first pressure absorbing device which absorbs a pressure fluctuation of the liquid in the first flow channel; a first measuring device which measures a pressure increase value in the first flow channel when the first pressure applying device is operated under a standard operating condition in which pressure in the first flow channel varies relatively moderately in proportion to a liquid feed amount to the first flow channel in the state of noncommunication where the liquid supply object and the first flow channel are not communicated with each other; a comparing device which compares the pressure increase value measured by the first measuring device with a predetermined pressure increase target value; and a pressure controlling device which controls the first pressure applying device according to a comparison result of the comparing device so as to correct the pressure applied into the first flow channel.

24 Claims, 15 Drawing Sheets

LIQUID SUPPLYING APPARATUS, LIQUID EJECTING APPARATUS AND PRESSURE CONTROL METHOD

BACKGROUND OF THE INVENTION

1. Field of the Invention

The present invention relates to a liquid supplying apparatus, a liquid ejecting apparatus, and a pressure control method, and in particular, relates to a pressure control technique related to liquid used for an inkjet head.

2. Description of the Related Art

With an ink supplying system which performs back-pressure control by feeding of ink in an inkjet recording apparatus, variances in a performance of a pump for pressurizing ink may potentially cause the ink supplying system to lose its ability to appropriately control pressure and control ink feeding. In particular, when a tube pump is applied as the pump used for ink feeding, such a loss in ability may be caused not only by variances in initial performance attributable to variances in size of parts used in the tube pump, an assembly variance of the tube pump, and a variance in an elasticity of a tube used for the tube pump, but also by a change over time in the elasticity of the tube.

In consideration of such problems, Japanese Patent Application Publication No. 2000-229422 discloses an inkjet recording apparatus including a first sensor which determines a number of revolutions of a motor used to drive a pump and a second sensor which measures a pressure of ink supplied to a head, wherein the inkjet recording apparatus outputs an automatic shutoff signal in a case where the number of revolutions of the motor falls outside of an allowable range when ink pressure is consistent with a proper value.

In addition, Japanese Patent Application Publication No. 2008-247021 discloses a fluid suction adjustment method of a tube pump which performs suctioning of a head, wherein the method includes storing suction capability information (suction amount, suction rate) of the tube pump and correcting an inherent suction force of the pump based on the suction capability information.

However, since the technique disclosed in Japanese Patent Application Publication No. 2000-229422 measures pressure in a continuous inkjet recording apparatus in a state where ink is being ejected from a head due to feeding of the ink by a pump and therefore measures a pressure value which includes variations in flow channel resistance due to nozzle clogging or the like, it is difficult to describe that an isolated performance of the pump is being accurately measured. On the other hand, when the configuration disclosed in Japanese Patent Application Publication No. 2000-229422 is used to measure a pressure increasing performance of a pump in a state where supply of ink has been stopped by closing a valve between a head and an ink supplying system, an abrupt increase in pressure occurs due to feeding of ink by the pump, which makes it difficult to accurately measure the pressure increasing performance of the pump.

In addition, while the technique disclosed in Japanese Patent Application Publication No. 2008-247021 enables variances in pump performance in an initial state to be corrected, since an isolated suction performance of the pump is measured before the pump is incorporated into an apparatus, a measurement result is stored in an IC chip, and the pump is subsequently controlled based on the suction performance stored in the IC chip, it is difficult to accommodate a change in suction performance over time. Meanwhile, although it is described that a fictitious flow rate is identified by referring to ink suction amount data and an ink suction amount due to driving of a tube pump is computed by multiplying a separately-acquired number of revolutions of the pump with the fictitious flow rate and that it is possible to discern a suction amount of the tube pump in a state where the tube pump is incorporated into an apparatus, the calculated suction amount is a value which includes variations in flow channel resistance due to nozzle clogging or the like. Therefore, it is difficult to describe that an isolated performance of the pump is being accurately discerned.

SUMMARY OF THE INVENTION

The present invention has been made in consideration of the above circumstances and an object thereof is to provide a liquid supplying apparatus, a liquid ejecting apparatus, and a pressure control method which achieve favorable liquid supply in which both a variance in pressure during supplying of a liquid and a variance in pressure due to a change over time have been corrected.

In order to attain an object described above, one aspect of the present invention is directed to a liquid supplying apparatus comprising: a first flow channel configured to be switchable between a state of communication with a liquid supply object and a state of noncommunication with the liquid supply object; a first pressure applying device which applies pressure to liquid in the first flow channel; a first pressure absorbing device which absorbs a pressure fluctuation of the liquid in the first flow channel; a first measuring device which measures a pressure increase value in the first flow channel when the first pressure applying device is operated under a standard operating condition in which pressure in the first flow channel varies relatively moderately in proportion to a liquid feed amount to the first flow channel in the state of noncommunication where the liquid supply object and the first flow channel are not communicated with each other; a comparing device which compares the pressure increase value measured by the first measuring device with a predetermined pressure increase target value; and a pressure controlling device which controls the first pressure applying device according to a comparison result of the comparing device so as to correct the pressure applied into the first flow channel.

Another aspect of the present invention is directed to a liquid ejecting apparatus comprising: a liquid ejecting device which ejects liquid; and a liquid supplying apparatus for supplying the liquid to the liquid ejecting device, the liquid supplying apparatus including: a first flow channel configured to be switchable between a state of communication with the liquid ejecting device and a state of noncommunication with the liquid ejecting device; a first pressure applying device which applies pressure to liquid in the first flow channel; a first pressure absorbing device which absorbs a pressure fluctuation of the liquid in the first flow channel; a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other; a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel.

Another aspect of the present invention is directed to a pressure control method comprising: a first pressure applying step of applying pressure into a first flow channel configured to be switchable between a state of communication with a liquid supply object and a state of noncommunication with the liquid supply object; a first pressure absorbing step of absorbing a pressure fluctuation of liquid in the first flow channel; a first measuring step of, in a state where the liquid supply object and the first flow channel are in a state of noncommunication with each other, applying the pressure into the first flow channel under a standard operating condition in which pressure in the first flow channel varies relatively moderately in proportion to a liquid feed amount to the first flow channel and measuring a pressure increase value in the first flow channel; a comparison step of comparing the pressure increase value measured in the first measuring step with a predetermined pressure increase target value; and a pressure control step of controlling pressure according to a comparison result in the comparing step so as to comet the pressure applied into the first flow channel.

According to the present invention, in a liquid supplying apparatus in which a pressure absorbing device for absorbing a pressure fluctuation in a first flow channel is provided in the first flow channel, a pressure increase in the first flow channel is measured when a first pressure applying device is operated under a standard operation condition in which pressure in the first flow channel varies relatively moderately in proportion to a liquid feed amount to the first flow channel in a state where a liquid supply object and the first flow channel are in non-communication with each other, and pressure applied by the first pressure applying device is corrected based on the measurement result. Therefore, it is possible to discern an isolated performance of the first pressure applying device from which fluctuations such as a flow channel resistance of the liquid supply object have been eliminated, an individual variance of the first pressure applying device and a variance due to a change in the first pressure applying device over time can be corrected, and the stable liquid supply can be achieved.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Configuration of Ink Supplying Apparatus

Figure 1:
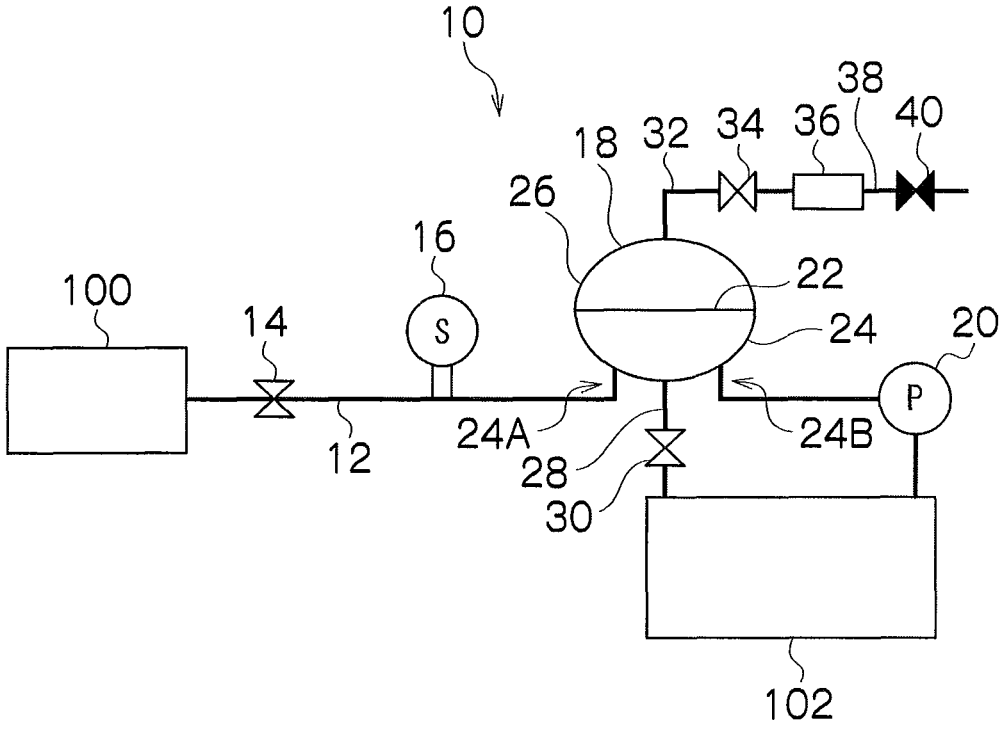
FIG. 1 is a block diagram showing a schematic configuration of a non-recycling ink supplying system according to a first embodiment of the present invention.

FIG. 1 is a block diagram showing a general configuration of an ink supplying apparatus according to a first embodiment of the present invention. An ink supplying apparatus 10 shown in FIG. 1 is a non-recycling ink supplying apparatus which supplies ink to an inkjet head (hereinafter, may also be simply referred to as a "head") 100 from an ink tank 102 and which controls an internal pressure (back-pressure) of the head 100 by a feed amount of ink. As shown in FIG. 1, the ink supplying apparatus 10 includes a liquid flow channel 12 which communicates (is connected) with the head 100, a head valve 14 which switches between communication and non-communication between the head 100 and the liquid flow channel 12, a pressure sensor 16 which measures an internal pressure of the liquid flow channel 12, a pressure absorbing chamber 18 which is provided in the liquid flow channel 12 and which performs pressure adjustment so as to suppress fluctuations in the internal pressure of the liquid flow channel 12, and a pump 20 connected to the pressure absorbing chamber 18 on an opposite side to the head 100.

As the head valve 14, a normally-open magnetic valve is applied in which opening and closing is controlled by a control signal. The pressure sensor 16 converts an internal pressure of the liquid flow channel 12 into an electric signal and outputs the electric signal. Applicable sensors as the pressure sensor 16 include a semiconductor piezo-resistance sensor, a capacitance sensor, and a silicon resonant sensor.

The pressure absorbing chamber 18 has a structure in which an elastic separation membrane 22 separates a liquid chamber 24 and an air chamber 26 from each other, and one communication port 24A of the liquid chamber 24 communicates with the head 100 via the liquid flow channel 12 and the head valve 14 while another communication port 24B communicates with the pump 20 which communicates with the ink tank 102. In addition, the liquid chamber 24 communicates with the ink tank 102 via a drain flow channel 28 and a drain valve 30.

The liquid chamber 24 is provided with the liquid flow channel 12 via which the head 100 and the pump 20 communicate with each other and functions to suppress an internal pressure fluctuation of the head 100 and a fluctuation in the internal pressure of the liquid flow channel 12 due to a pulsating flow caused by an operation of the pump 20. A liquid inside the liquid chamber 24 is discharged to the ink tank 102 when the drain valve 30 is opened.

The air chamber 26 communicates with a sub air chamber 36 via a gas flow channel 32 and a communication valve 34. The sub air chamber 36 is configured to be communicable with atmosphere via an atmosphere communication valve 40 provided in an atmosphere communication channel 38. That is, the air chamber 26 can be communicated with the sub air chamber 36 by opening the communication valve 34 and realizes a state equivalent to increasing a capacity of the air chamber 26. In other words, the sub air chamber 36 can be used as a buffer zone of the air chamber 26. In addition, the sub air chamber 36 can be communicated with the atmosphere by opening the atmosphere communication valve 40.

A normally-open magnetic valve is applied as the communication valve 34 and a normally-closed magnetic valve is applied as the atmosphere communication valve 40.

Description of Pump

Figure 2A:
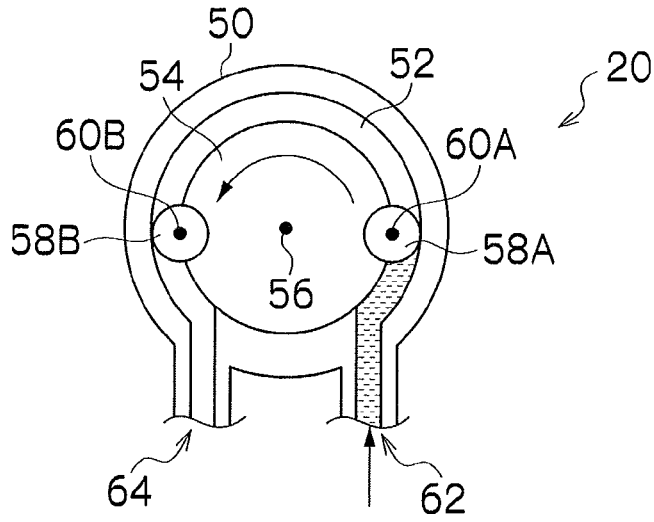
FIGS. 2A, 2B, and 2C illustrate operations of a tube pump applied to the ink supplying system shown in FIG. 1.
Figure 2B:
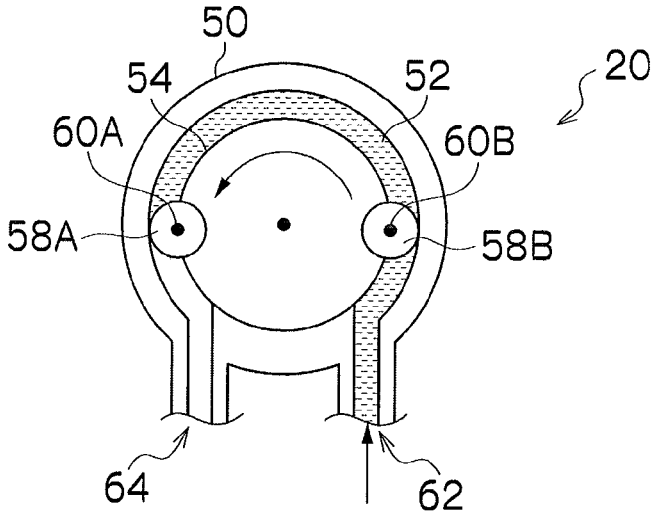
Figure 2C:
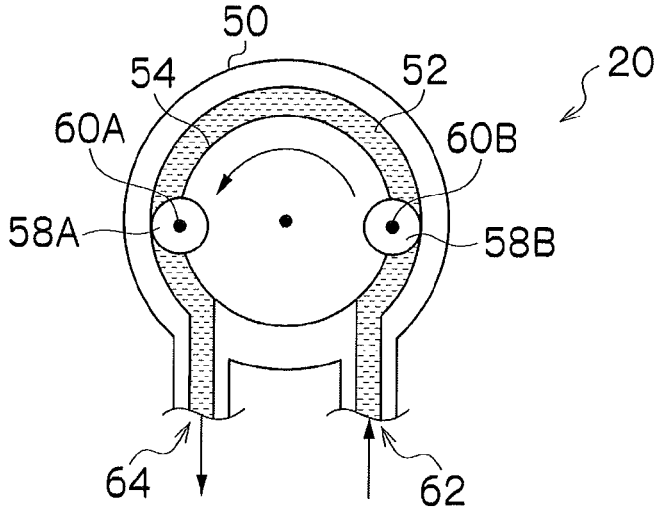

For the pump 20, a tube pump configured to be switchable between forward and reverse operations is favorably used. FIGS. 2A to 2C are explanatory diagrams schematically illustrating a general configuration and operations of the tube pump 20. The tube pump 20 shown in FIGS. 2A to 2C has a structure in which an elastic tube 52 is annularly arranged inside a pump frame 50 and a rotor 54 which rotates along the tube 52 is provided inside the tube 52. A motor (not shown) is coupled to the central axis 56 of the rotor 54. The rotor 54 is configured to rotate in either a clockwise direction or a counterclockwise direction as seen in FIGS. 2A to 2C when the motor is operated. A controlled motor such as a stepping motor is applied as the motor (not shown).

Rollers 58A and 58B arranged so as to squash the tube 52 are provided on an edge of the rotor 54. The rollers 58A and 58B are structured to rotate (orbit) around an axis of rotation of the rotor 54 together with the rotor 54 while rotating (spinning) around axes of rotation 60A and 60B so as to maintain a squashed state of the tube 52.

FIGS. 2A to 2C schematically illustrate operations of the tube pump 20 when ink (liquid) suctioned from one joint 62 is ejected from another joint 64. The joint 62 in FIGS. 2A to 2C is on a side which is communicated with the ink tank 102 shown in FIG. 1 and the joint 64 is on a side which is communicated with the liquid flow channel 12. In the tube pump 20, predetermined locations of the elastic tube 52 are squashed by rollers 58A and 58B (FIG. 2A) and the rollers 58A and 58B are moved while the squashed state of the tube 52 (FIG. 2B) is maintain to push out the liquid inside the tube 52. After the rollers 58A and 58B are moved, the squashed locations are restored to original shapes by a restoring force of the tube 52. During the restoration, a vacuum is created inside the tube 52 and next ink is suctioned. By continuously performing these operations, ink suctioned from one joint 62 is ejected from the other joint 64 (FIG. 2C).

In addition, by rotating the rotor 54 in a reverse direction (a clockwise direction as seen in FIGS. 2A to 2C), ink can be suctioned from the other joint 64 and ejected from the one joint 62. In other words, by switching directions of rotation (operating directions) of the rotor 54, flow directions of ink can be switched. Therefore, by switching operating directions as appropriate when an internal pressure of a liquid flow channel connected to the joint 62 (or the joint 64) fluctuates, the internal pressure of the liquid flow channel can be kept constant.

Configuration of Control System

Figure 3:
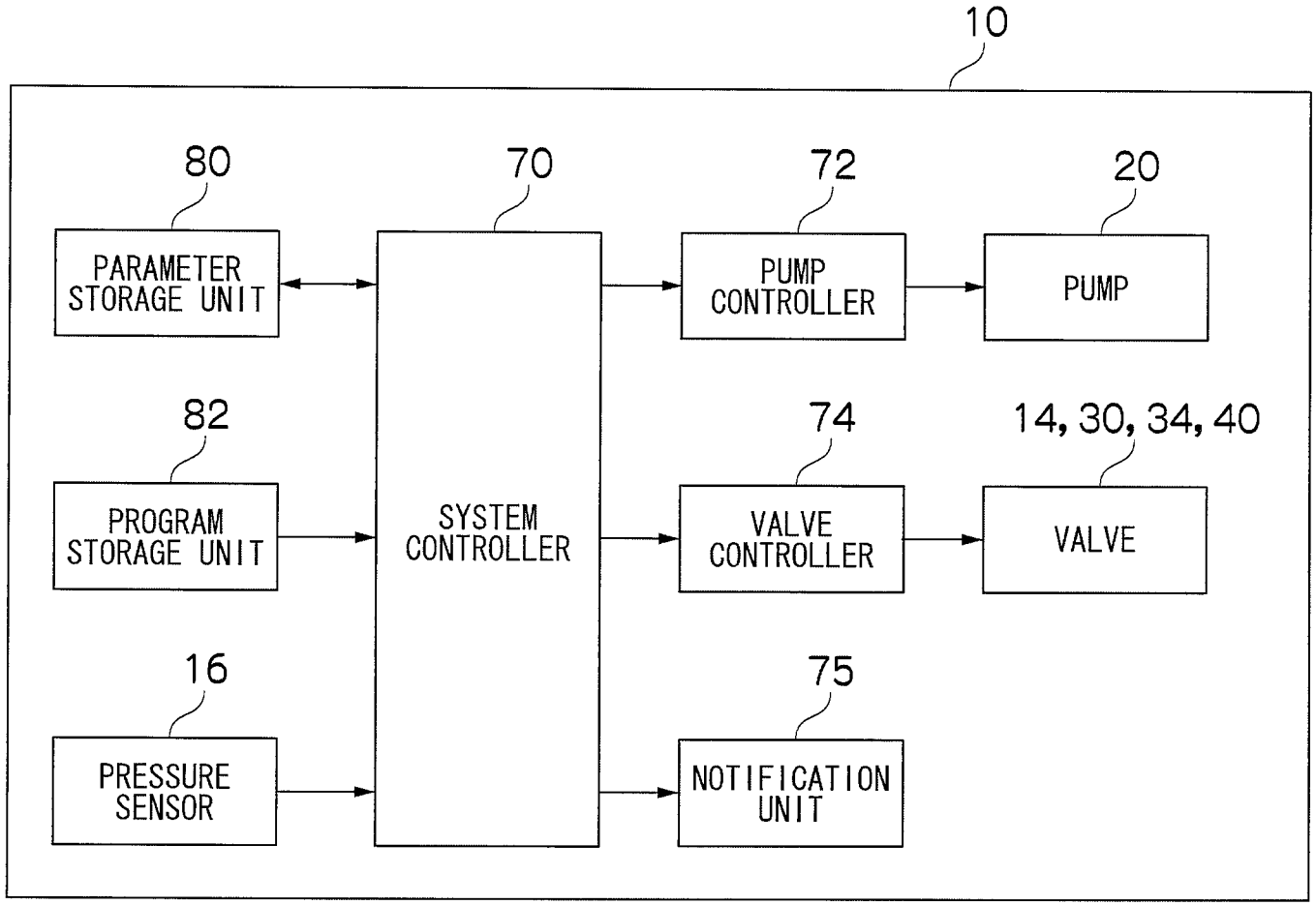
FIG. 3 is a block diagram showing a configuration of an ink supply controller applied to the ink supplying system shown in FIG. 1.

FIG. 3 is a block diagram showing a schematic configuration of a control system of the ink supplying apparatus 10 according to the present embodiment. As shown in FIG. 3, the ink supplying apparatus 10 includes a system controller 70 which integrally controls the control system, a pump controller 72 which controls the pump 20 based on a control signal sent from the system controller 70, a valve controller 74 which controls opening and closing of valves such as the head valve 14, the drain valve 30, the communication valve 34, and the atmosphere communication valve 40, and a notification unit 75 which, upon an occurrence of a failure at respective parts of the apparatus, issues a notification of that effect.

A parameter storage unit 80 shown in FIG. 3 stores various parameters used to control the ink supplying apparatus 10 and a data table to be referenced during control. For example, a data table is stored which indicates a relationship between a liquid feed amount of a pump and a pressure value inside a liquid flow channel, which will be described later.

A program storage unit 82 stores programs used to control the ink supplying apparatus 10. The system controller 70 integrally controls the ink supplying apparatus 10 by reading out and executing various control programs stored in the program storage unit 82 and by referencing various parameters and the data table stored in the parameter storage unit 80.

The ink supplying apparatus 10 according to the present embodiment is configured to suppress fluctuations of pressure inside the liquid flow channel 12 by controlling operations of the various valves including the head valve 14 and controlling the operation of the pump 20 based on information on the pressure inside the liquid flow channel 12 which is obtained from the pressure sensor 16. Pressure information (a pressure increase to be described later) obtained from the pressure sensor 16 is sequentially written into the parameter storage unit 80. Hereinafter, a pressure control method of the liquid flow channel 12 via which the head 100 and the ink tank 102 communicate with each other will be described in detail.

Description of Pressure Absorbing Chamber

Figure 4A:
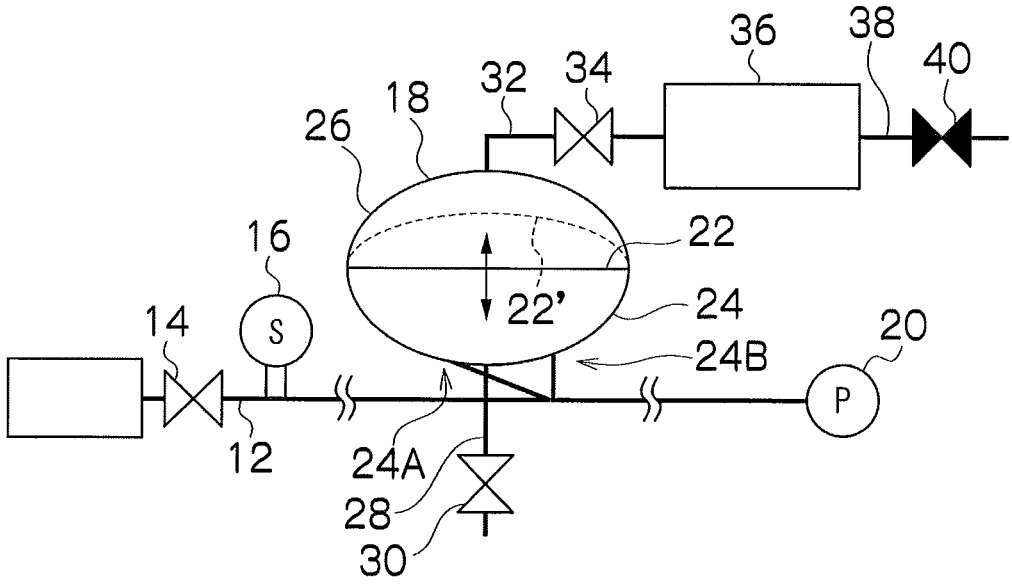
FIGS. 4A and 4B are diagrams illustrating a structure and operations of a pressure absorbing chamber shown in FIG. 1.
Figure 4B:
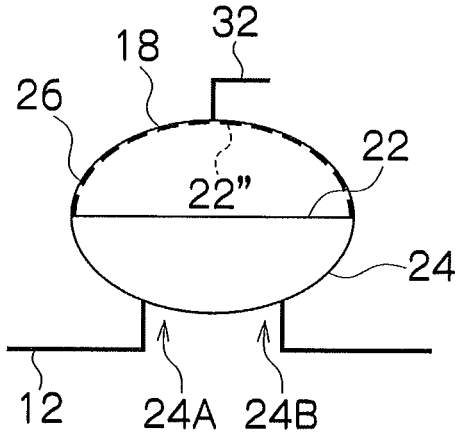

FIGS. 4A and 4B are diagrams illustrating operations of the pressure absorbing chamber 18 which is applied to the ink supplying apparatus 10 according to the present embodiment. Note that, in FIGS. 4A and 4B, a part of the configuration shown in FIG. 1 has been omitted. The pressure absorbing chamber 18 shown in FIG. 4A functions as a damper which enlarges and reduces a capacity of the liquid chamber 24 by deforming the elastic separation membrane 22 which separates the liquid chamber 24 from the air chamber 26 to suppress abrupt fluctuations of the pressure inside the liquid flow channel 12 so as to cause the pressure inside the liquid flow channel 12 to become proportional to a liquid feed amount of the pump 20 (to prevent the amount of liquid outputted from the pressure absorbing chamber 18 from fluctuating).

For example, when a liquid feed amount of the pump 20 (pressure applied by the pump 20) rises abruptly, the elastic separation membrane 22 operates to expand the capacity of the liquid chamber 24 and an increase of the liquid feed amount is temporarily held inside the liquid chamber 24. Since an amount of liquid flowing out of the liquid chamber 24 increases gradually instead of abruptly, an abrupt increase in the pressure inside the liquid flow channel 12 can be avoided. In FIG. 4A, the elastic separation membrane 22 depicted by a solid line is in an initial state while the elastic separation membrane which is denoted by reference numeral 22' and which is depicted by a dashed line is in a state where the elastic separation membrane has been operated to expand the capacity of the liquid chamber 24. In addition, in FIG. 4B, the elastic separation membrane which is denoted by reference numeral 22" and which is depicted by a solid dashed line is in a state where the elastic separation membrane is in contact with a ceiling surface of the air chamber 26 and the capacity of the liquid chamber 24 has been maximized. When the state shown in FIG. 4B is reached and an abrupt pressure fluctuation occurs in the pump 20, the pressure inside the liquid flow channel 12 fluctuates abruptly.

From the perspective of pressure absorbing performance, the greater the capacity of the air chamber 26, the better. However, since there is a limit to how much the elastic separation membrane 22 deforms, the sub air chamber 36 is provided in addition to the air chamber 26 in order to ensure that an adjustment of a position of the elastic separation membrane 22 is performed in a stable manner and to prevent the elastic separation membrane 22 from being subjected to excessive stress.

Figure 5:
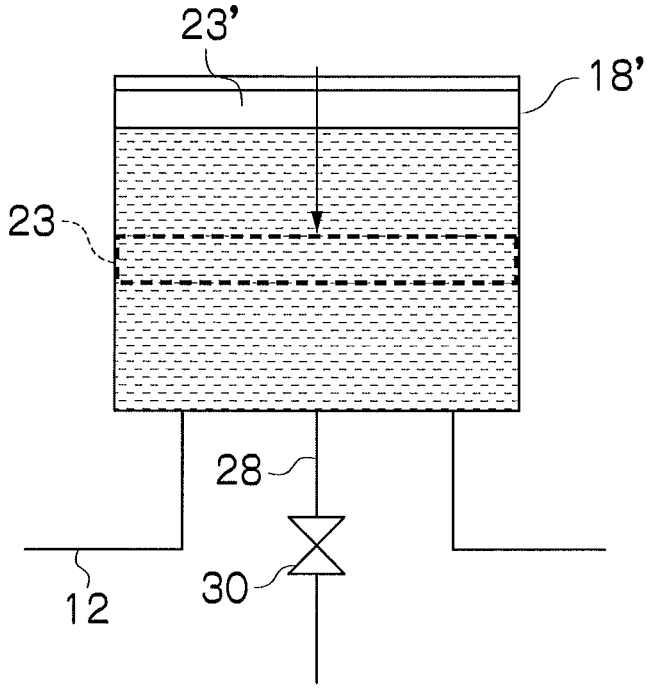
FIG. 5 is a structure diagram showing another mode of the pressure absorbing chamber shown in FIG. 1.

Moreover, structures of the pressure absorbing chamber 18 are not limited to the structure shown in FIGS. 4A to 4B. For example, as in a case of a pressure absorbing chamber 18' shown in FIG. 5, a structure is conceivable in which a ceiling wall 23 of a liquid chamber 24 is movably configured and the ceiling wall 23 is biased toward inside of the pressure absorbing chamber 18' by an elastic force of an elastic member such as a spring. According to this structure, a capacity of the pressure absorbing chamber 18' increases as the ceiling wall 23 rises with an increase in a liquid feed amount, and the capacity of the pressure absorbing chamber 18' becomes maximum when the ceiling wall 23 reaches a position which is denoted by reference numeral 23' and which is depicted by a solid line.

In addition, in the pressure absorbing chamber 18 shown in FIGS. 4A to 4B, since a pressure of a gas inside the air chamber 26 is applied to the elastic separation membrane 22, the elastic separation membrane 22 may or may not be elastic. An inelastic member having an area corresponding to a surface area of an interior of the air chamber 26 (a member capable of changing a volumetric distribution of the liquid chamber 24 and the air chamber 26) can also be applied.

Figure 6:
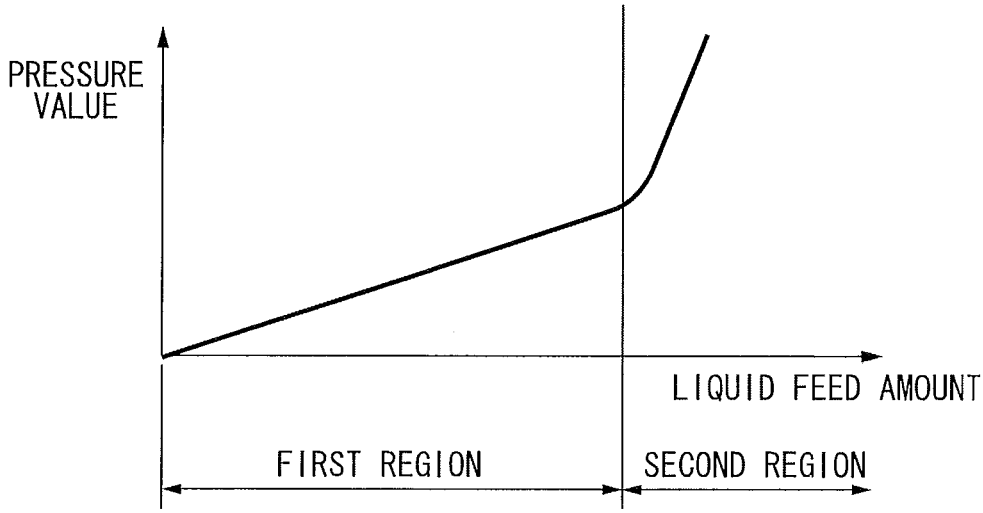
FIG. 6 is a diagram illustrating a relationship between a liquid feed amount and a pressure value of the pressure absorbing chamber shown in FIGS. 4A to 4B.

FIG. 6 is a diagram illustrating a relationship between a liquid feed amount to the head 100 (an ejection amount of the pump 20) and a pressure value inside the liquid flow channel 12 (a value measured by the pressure sensor 16 shown in FIG. 1). As shown in FIG. 6, there is a first region in which, when a liquid feed amount is increased, a pressure value rises moderately in proportion to the increase in the liquid feed amount, and a second region in which a pressure value rises abruptly in response to an increase in the liquid feed amount. The first region corresponds to a state where the elastic separation membrane 22 elastically deforms from an initial state (a position depicted by the solid line in FIGS. 4A to 4B) to a position immediately before coming into contact with the ceiling surface of the air chamber 26, and the second region corresponds to a case where a liquid feed amount is additionally increased in a state where the elastic separation membrane 22 is in contact with the ceiling surface of the air chamber 26.

Specifically, the first region shown in FIG. 6 is a state where the elastic separation membrane 22 is able to deform to increase the capacity of the liquid chamber. On the other hand, the second region is a state where the elastic separation membrane 22 is regulated by the ceiling surface of the air chamber 26 and the elastic separation membrane 22 is unable to deform to increase the capacity of the liquid chamber 24.

In other words, the first region is a region corresponding to a state in which precise (moderate) pressure control is performed under relatively low pressure such as a case where a back-pressure during an ejecting operation of the head 100 is kept within a constant range. The second region is a region in which relatively high pressure of around several ten kPa is handled, and corresponds to a case where the pressure absorbing chamber 18 does not function as a damper and, for example, pressurized purging of the head 100 is performed.

Description of Pressure Correction Control

As described earlier, with the ink supplying apparatus 10 according to the present embodiment, a feeding speed of ink (a rotational speed of the pump 20) is varied to control pressure inside the liquid flow channel 12 (a liquid feed amount of the pump 20) in order to keep a back-pressure (internal pressure) of the head 100 within a certain range. With the ink supplying apparatus 10 configured as described above, there is a possibility where pressure control and liquid feed control are not performed in an adequate manner due to variances in the performance of the pump 20. In particular, with a tube pump which is applied to the present embodiment, while forward and reverse control can be easily performed, a pressure increasing performance or a pressure reducing performance changes over time due not only to initial variances such as a variance in used parts, an assembly variance, and a variance in elasticity of the tube but also to a change over time in the elasticity of the tube.

For example, the tube remains in a somewhat hard state for a while after start of use. In this state, a predetermined liquid feed amount is realized by operating the pump at a predetermined rotational speed. As the tube settles and softens in the course of use, liquid feed amount increases even when operated at the same rotational speed. As the tube further softens due to further use, the tube is blocked by pressure and becomes incapable of liquid feeding.

In the present embodiment, pressure inside the liquid flow channel 12 rises moderately with respect to a liquid feed amount of the pump 20. At the same time, by operating the pump 20 under a standard operating condition in which a sufficient resolution of a liquid feed amount (generated pressure) is obtained, a pressure increase inside the liquid flow channel 12 is obtained, the pressure increase is compared with a pressure increase target value, and a drive condition (rotational speed) of the pump 20 is corrected (changed) depending on the comparison result. According to this configuration, a constant performance of the pump (liquid feed amount) is maintained even in cases where there is an individual variance in the performance of the pump 20 or where a performance degradation has occurred over time.

For example, in FIG. 6, if it is assumed that a liquid feed amount of 50 ml corresponds to a boundary between a state where a pressure value varies moderately and a state where a pressure value varies abruptly (a boundary between the first region and the second region shown in FIG. 6), then a liquid feed amount for measuring a pressure increase favorably ranges between 10 ml and 40 ml. Standard operating conditions for this liquid feed amount include a mode in which a liquid feed speed is set to 5 ml/second and a liquid feed time is set to 4 seconds. Moreover, a liquid feed amount range for measuring a pressure increase is determined as appropriate by a capability of the pump 20 and a capacity of the pressure absorbing chamber 18.

In this case, the "pressure increase target value" indicates an isolated performance of the pump 20 and is expressed as an increase in a pressure value for each liquid feed amount. For example, a mode is conceivable in which a relationship between a liquid feed amount and a pressure value in the first region shown in FIG. 6 is compiled into a data table and stored in a predetermined memory. The "pressure increase target value" may be experimentally obtained or obtained by a simulation or the like.

Steps of measuring a pressure increase are as follows. First, the head valve 14 shown in FIG. 1 is closed to place the pump 20 and the head in a noncommunication state. Next, the pump 20 is operated under the standard operating condition and the pressure increase is measured by the pressure sensor 16.

The pressure increase may be a value obtained by storing a measured value of the pressure sensor 16 before the operation of the pump 20, and subtracting the measured value of the pressure sensor 16 before the operation of the pump 20 from a measured value of the pressure sensor 16 after the pump is operated under the standard operating condition. In other words, the "pressure increase value" is an amount of increase in the pressure when the pump 20 performs liquid feeding and indicates a difference between a pressure value measured by the pressure sensor 16 before the liquid feeding and a pressure value measured by the pressure sensor 16 after the liquid feeding.

Due to individual differences in the pump 20 and a degradation in the performance of the pump 20 over time, the pressure increase value is not constant. In other words, even if the pump 20 is operated at a given rotational speed, as the tube 52 (refer to FIGS. 2A to 2C) inside the pump 20 softens, a liquid feed amount becomes greater than that in the initial state (a state where the tube 52 is hard) and the pressure increase rises. Therefore, the liquid feed speed (rotational speed) of the pump 20 is corrected so as to cause the pressure increase value to assume the pressure increase target value (in this case, so as to lower the pressure increase value).

In addition, as another function, a degradation of the performance of the pump 20 over time can be discerned by comparing a measured pressure increase value and an initial pressure increase value measured when the pump 20 has been newly mounted. For example, a configuration can be adopted in which, when the pressure increase value drops by a predetermined value or a predetermined rate or greater, a notification is issued to the effect that a performance degradation of the pump 20 has exceeded an allowable range (that the pump 20 has reached the end of its product life) in order to prompt a user to perform maintenance (replacement) of the pump 20.

Furthermore, an abnormality of a liquid flow channel can be discerned by storing a measured pressure increase value and comparing a measured pressure increase value with the previous measured pressure increase. For example, in a case of a decrease equal to or greater than a predetermined value or a predetermined rate from a previous measured value, a leakage may have occurred at a liquid flow channel. On the other hand, in a case of an increase equal to or greater than a predetermined value or a predetermined rate from a previous measured value, a blockage may have occurred at the liquid flow channel. By notifying a user of such information as a notification, the user is able to execute maintenance at an appropriate timing. Moreover, applicable modes for "notification" include a mode in which text information is displayed on a display apparatus, a mode in which a notification is made by sound, and a mode in which a notification is made by a buzzer or an alarm tone.

Figure 7:
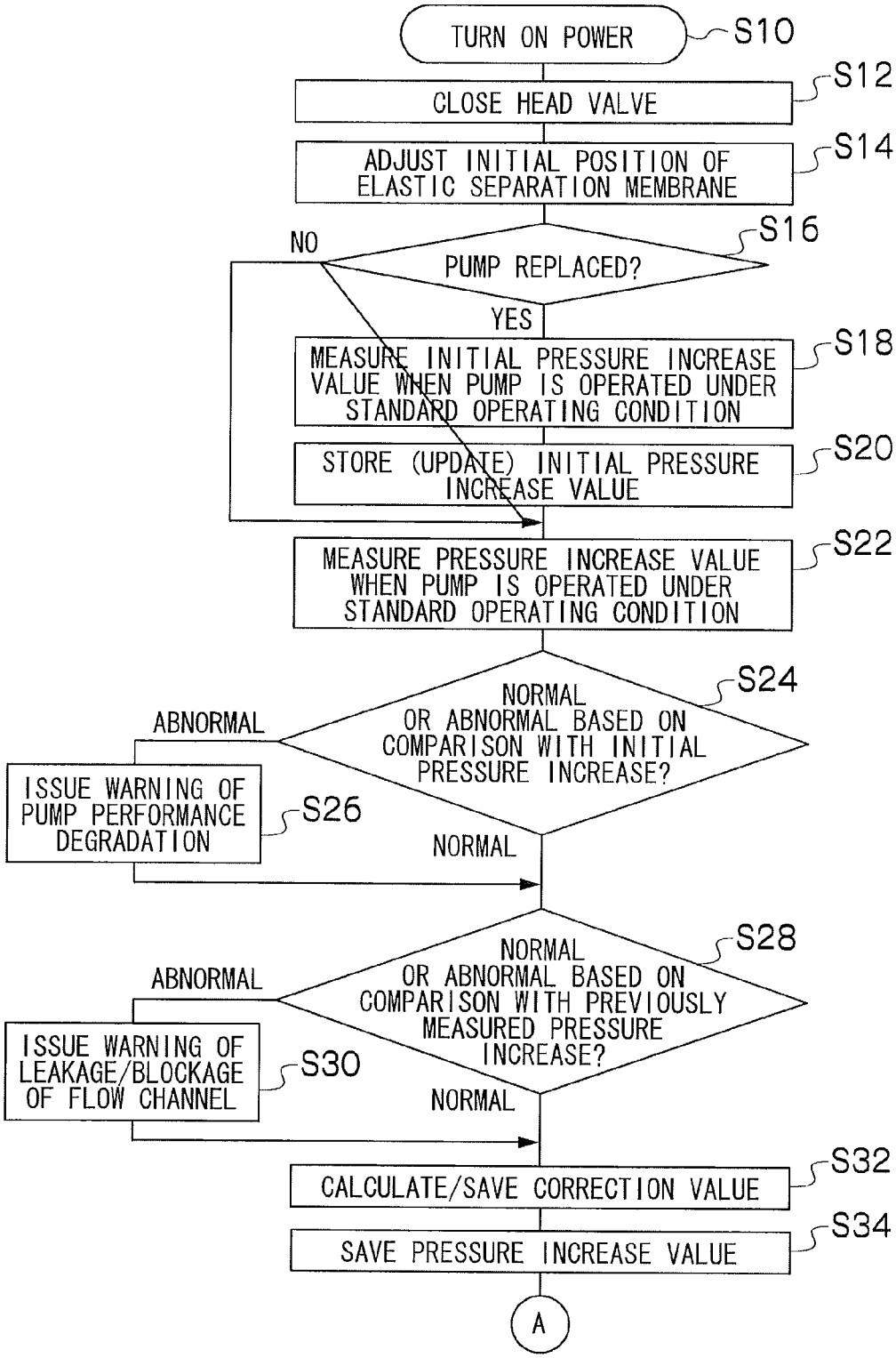
FIG. 7 is a flow chart showing a flow of pressure correction in the ink supplying system shown in FIG. 1.
Figure 8:
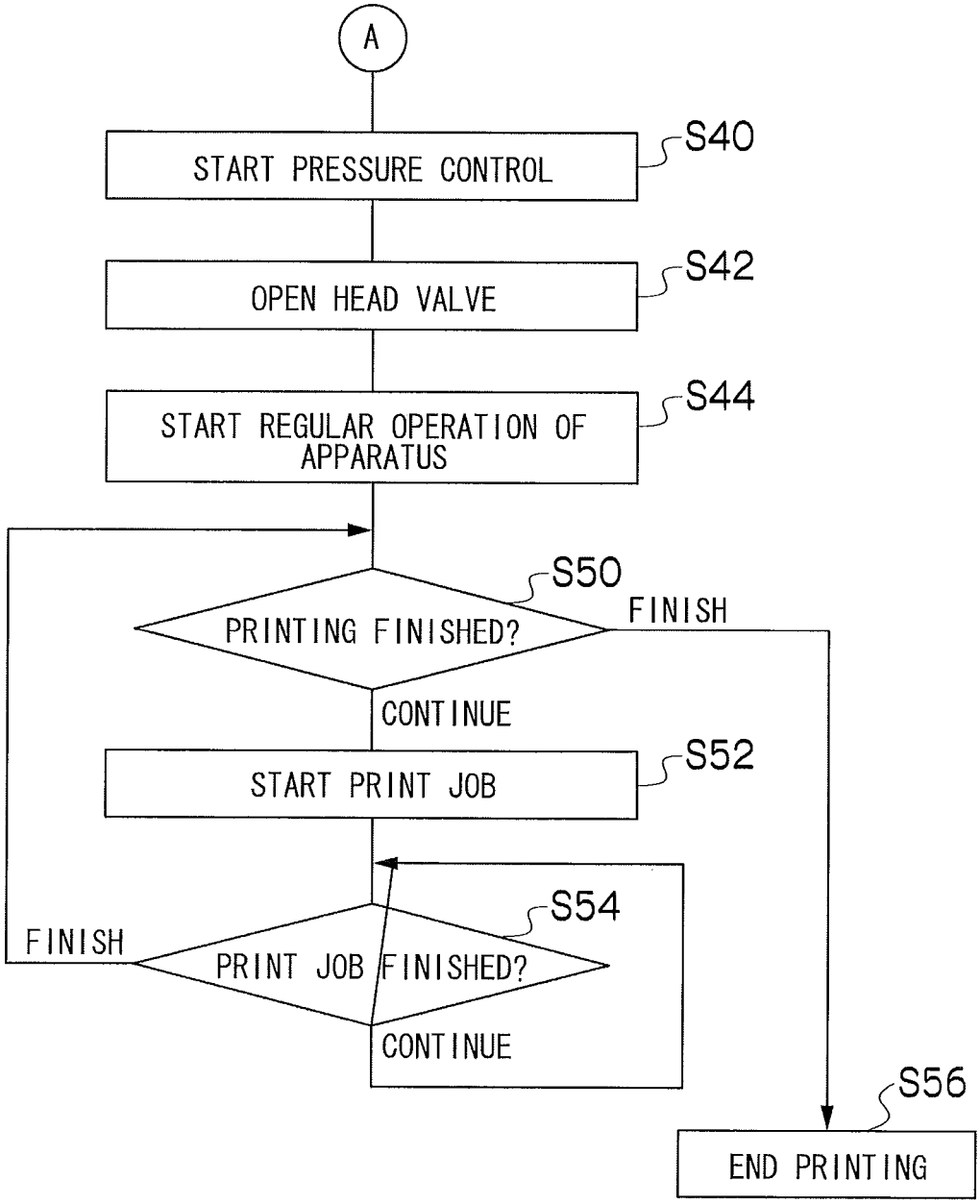
FIG. 8 is a flow chart showing a flow of pressure control in the ink supplying system shown in FIG. 1.

FIGS. 7 and 8 are flow charts showing a flow of pressure correction control which is applied to the non-recycling ink supplying apparatus 10 shown in FIG. 1. Control steps according to the flow charts described below are executed in a state where the ink supplying apparatus 10 is connected to the head 100 and the head 100 is operational.

First, power is turned on (step S10 in FIG. 7) and the head valve 14 (refer to FIG. 1) is closed (step S12 in FIG. 7). Next, an initial position of the elastic separation membrane 22 (refer to FIG. 1) is adjusted (step S14 in FIG. 7). During the initial position adjustment process of the elastic separation membrane 22 in step S14, the drain valve 30 (refer to FIG. 1) is closed, the communication valve 34 and the atmosphere communication valve 40 are opened, and liquid is fed from the pump 20 in this state while a measured value of the pressure sensor 16 is monitored, and the pump 20 is stopped at a timing where the measured value changes abruptly. This is a state where the elastic separation membrane 22 comes into contact with the ceiling surface of the air chamber 26 (a state where the air chamber 26 has a capacity of zero).

Next, the drain valve 30 is opened, and after a predetermined amount of ink is discharged from the liquid chamber 24, the drain valve 30 is closed. As a result, the capacity of the air chamber 26 increases in correspondence with the amount of discharged ink and the elastic separation membrane 22 moves. An example of the initial position of the elastic separation membrane 22 is a position where a capacity of the liquid chamber 24 and a capacity of the air chamber 26 are evenly distributed (i.e. the capacity of the liquid chamber 24=the capacity of the air chamber 26).

Returning now to FIG. 7, in step S14, once the initial position of the elastic separation membrane 22 is adjusted, a determination is made as to whether or not the pump 20 (refer to FIG. 1) has been replaced (step S16). If the pump 20 has been replaced ("Yes" in step S16), the pump 20 is operated under the standard operating condition and the initial pressure increase value is measured (step S18). The initial pressure increase value is stored in a predetermined memory (step S20) and the procedure continues to step S22. On the other hand, if the pump 20 has not been replaced ("No" in step S16), the procedure continues to step S22.

In step S22, the pump 20 is operated under the standard operating condition and the pressure increase value is measured. The measured pressure increase value is compared with the initial pressure increase stored in advance (step S24), and when the pressure increase value has changed by a predetermined amount or a predetermined rate or more ("abnormal" in step S24), a warning is issued to the effect that there is a possibility of a performance degradation of the pump 20 (step S26). On the other hand, in step S24, when the pressure increase value has not changed by a predetermined amount or a predetermined rate or more ("normal" in step S24), the procedure continues to step S28 and a comparison is made with a previously measured pressure increase value (step S28).

When the newly measured pressure increase value has changed by a predetermined amount or a predetermined rate or more from the previously measured pressure increase value ("abnormal" in step S28), a warning is issued to the effect that there is a possibility of an occurrence of an abnormality in the liquid flow channel (step S30). On the other hand, in step S28, when the newly measured pressure increase value has not changed by a predetermined amount or a predetermined rate or more from the previously measured pressure increase value ("normal" in step S28), the procedure continues to step S32.

In step S32, the measured pressure increase value is compared with a pressure increase target value stored in advance, a corrected value of a control parameter of the pump 20 is obtained and stored, and the measured values of the pressure increase value are stored as a table in which the measured values of the pressure increase value are associated with the number of measurements (measurement timings) (step S34).

Once the corrected value of the control parameter of the pump 20 is stored in step S32, the procedure continues to step S40 in FIG. 8 and pressure control based on the corrected value of the control parameter is started (step S40). First, the head valve 14 is opened (step S42), the pump 20 is operated to supply ink to the head valve 14, a regular operation of the apparatus is started (step S44), and the procedure continues to step S50.

In step S50, a determination is made as to whether or not to finish printing (operation of the head valve 14). In other words, in step S50, a determination is made as to whether or not there are jobs in a print queue, and when there are jobs in the print queue ("continue" in step S50), the print jobs are sequentially executed (step S52). During execution of a print job, an execution status of the print job is monitored (step S54), and once the print job being executed is finished ("finish" in step S54), the control returns to step S50.

On the other hand, in step S50, if there are no jobs in the print queue ("finish" in step S50), printing is finished (step S56). Moreover, in the present embodiment, while a mode has been exemplified in which a corrected value of a control parameter of the pump 20 is obtained before a regular operation (at the power activation) of the head 100, the correction control is at least executed before a regular operation of the head 100 and may be executed as appropriate during an idle period of the head 100 or the like.

A configuration may be adopted in which the pressure correction control described above is fabricated as a program to be stored in a predetermined storage device (for example, the program storage unit 82 shown in FIG. 3), whereby the program is read out and executed when executing the pressure correction control.

According to the ink supplying apparatus 10 configured as described above, a pressure absorbing chamber 18 is provided in a liquid flow channel 12 via which a head 100 and a pump 20 communicate with each other, a pressure increase value is measured when the pump 20 is operated under a standard operating condition in which an elastic separation membrane 22 which separates a liquid chamber 24 and an air chamber 26 of the pressure absorbing chamber 18 from each other does not come into contact with a ceiling surface of the air chamber 26, the measured value is compared with a pressure increase target value, and a liquid feed speed of the pump 20 is corrected so as to cause pressure in the liquid flow channel 12 to assume the pressure increase target value. Therefore, a degradation in performance of the pump 20 due to an individual variance or a change over time is corrected.

In addition, by storing a pressure increase value after a pump 20 is newly mounted and comparing a measured pressure increase value with an initial pressure increase value, a degradation in performance of the pump 20 over time can be discerned. Furthermore, by comparing a previous measured value with a current measured value, an abnormality (leakage, blockage) of the liquid flow channel 12 can also be discerned.

Second Embodiment

Figure 9:
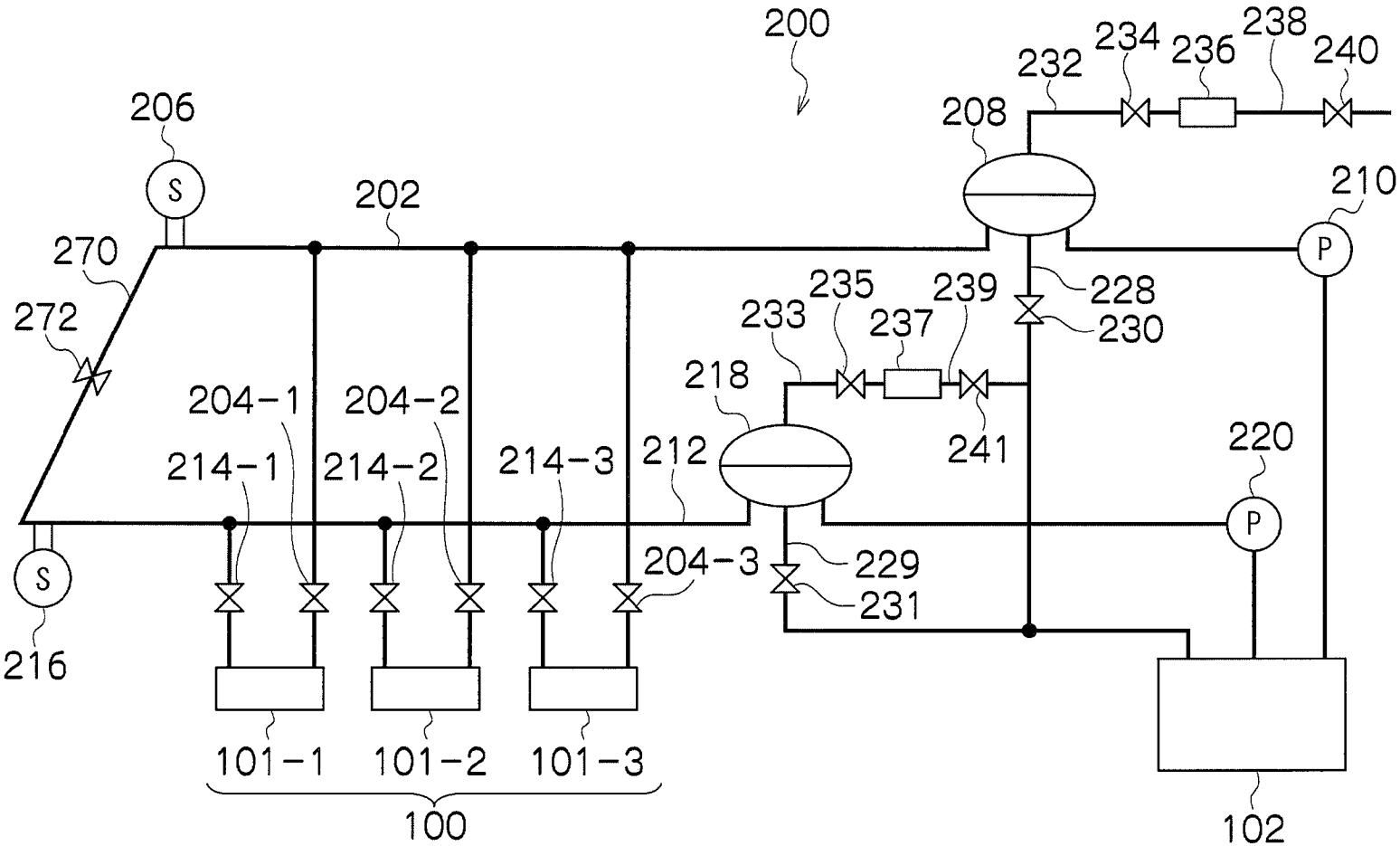
FIG. 9 is a block diagram showing a schematic configuration of a recycling ink supplying system according to a second embodiment of the present invention.

Next, an ink supplying apparatus according to a second embodiment of the present invention will be described. FIG. 9 is a block diagram showing a schematic configuration of an ink supplying apparatus 200 according to the present embodiment. The following description will focus on components which differ from the ink supplying apparatus 10 described with reference to FIGS. 1 to 8.

General Configuration

The ink supplying apparatus 200 illustrated in FIG. 9 is a recycling ink supplying apparatus including a supply flow channel 202 and a recovery flow channel 212, wherein a supply flow channel pressure sensor 206 is provided in the supply flow channel 202 and a recovery flow channel pressure sensor 216 is provided in the recovery flow channel 212. In addition, a first pressure absorbing chamber 208 is provided with the supply flow channel 202 and a second pressure absorbing chamber 218 is provided with the recovery flow channel 212. The first pressure absorbing chamber 208 is communicated with an ink tank 102 via a supply pump 210 and the second pressure absorbing chamber 218 is communicated with the ink tank 102 via a recovery pump 220.

A head 100 shown in FIG. 9 is a head having a structure in which a plurality of head modules 101-1, 101-2, 101-3, . . . , (hereinafter, the plurality of head modules will be collectively described as a head module 101) are joined together. Each of the head modules 101 is communicated with the supply flow channel 202 via supply valves 204-1, 204-2, 204-3, . . . , (hereinafter, the plurality of supply valves will be collectively described as a supply valve 204) and with the recovery flow channel 212 via recovery valves 214-1, 214-2, 214-3, . . . , (hereinafter, the plurality of supply valves will be collectively described as a recovery valve 214).

The supply channel 202 is communicated with the recovery flow channel 212 via a bypass flow channel 270. In addition, a bypass flow channel valve 272 is provided in the bypass flow channel 270. As the supply pump 210 and the recovery pump 220, tube pumps having the structure shown in FIGS. 2A to 2C are applied. The supply pump 210 shown in FIG. 9 controls pressure (liquid feed amount) of the supply flow channel 202 which supplies ink from the ink tank 102 to the head 100, and the recovery pump 220 controls pressure (liquid feed amount) of the recovery flow channel 212 which recovers (recycles) ink from the head 100 to the ink tank 102. Pumps having the same performance (capacity) can be applied as the supply pump 210 and the recovery pump 220.

The supply pump 210 and the recovery pump 220 rotate only in one direction when the head 100 is not in operation (in other words, when ink is flowing in a stable manner), and when the head 100 is in operation and internal pressure of the head 100 decreases due to ejection of ink, the supply pump 210 increases rotational speed while the recovery pump 220 reverses rotation to increase the internal pressure of the head 100.

Since the first pressure absorbing chamber 208 and the second pressure absorbing chamber 218 share the same structure as the pressure absorbing chamber 18 shown in FIGS. 4A to 4B, a description will be hereby omitted. Moreover, drain flow channels 228 and 229, gas flow channels 232 and 233, drain valves 230 and 231, communication valves 234 and 235, sub air chambers 236 and 237, atmosphere communication channels 238 and 239, and atmosphere communication valves 240 and 241 shown in FIG. 9 respectively correspond to the drain flow channel 28, the drain valve 30, the gas flow channel 32, the communication valve 34, the sub air chamber 36, the atmosphere communication channel 38, and the atmosphere communication valve 40 shown in FIG. 1.

Furthermore, latched magnetic valves are applied as the drain valves 230 and 231, normally-open magnetic valves are applied as the communication valves 234 and 235, and normally-closed magnetic valves are applied as the supply valve 204, the recovery valve 214, and the atmosphere communication valves 240 and 241.

Description of Pressure Correction Control

Figure 10:
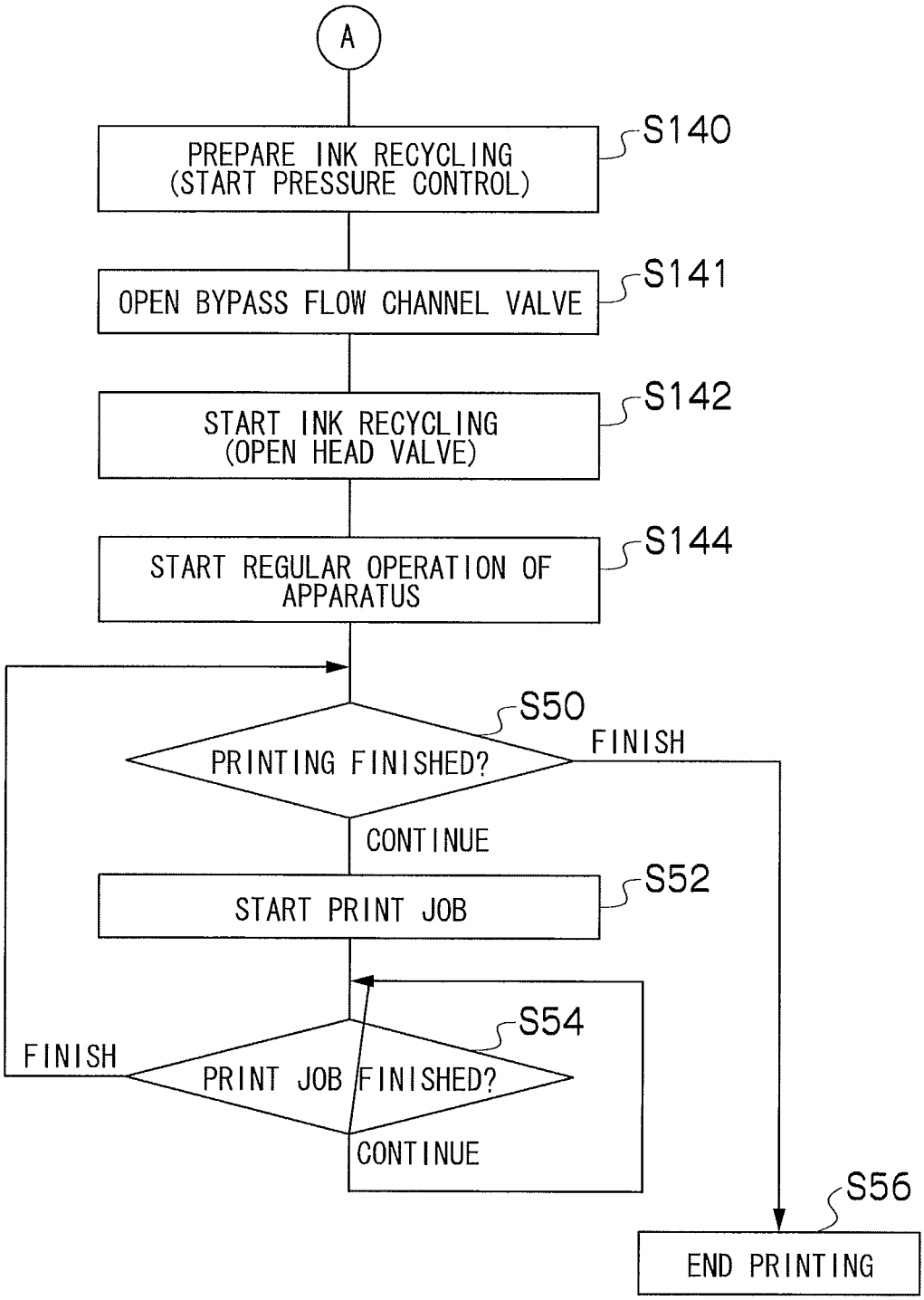
FIG. 10 is a flow chart showing a flow of pressure control in the ink supplying system shown in FIG. 9.

Next, pressure correction control in the recycling ink supplying apparatus 200 having the structure shown in FIG. 9 will be described. With pressure correction control applied to the ink supplying apparatus 200, after executing steps S10 to S34 shown in FIG. 7, processes of steps S140 and thereafter shown in FIG. 10 are executed. In the pressure correction control according to the present embodiment, in step S14 shown in FIG. 7, the supply valve 204 provided in a flow channel via which the supply flow channel 202 and each head module 101 communicate with one another is closed, the recovery valve 214 provided in a flow channel via which the recovery flow channel 212 and each head module 101 communicate with one another is closed, and the bypass flow channel valve 272 is also closed.

In addition, for a measurement of an initial pressure increase value in step S18 and the measurement of a pressure increase value in step S22 in FIG. 7, a pressure increase value during a forward (CW) operation of the supply pump 210 (refer to FIG. 9) is measured by the supply flow channel pressure sensor 206 and a pressure increase value during a reverse (CCW) operation of the recovery pump 220 is measured by the recovery flow channel pressure sensor 216.

Subsequently, processes of steps S16 to S34 in FIG. 7 are executed as appropriate, and the procedure continues to step S140. In step S140 in FIG. 10, preparations for recycling ink are performed and pressure control is started. Consequently, the bypass flow channel valve 272 is opened (step S141), head valves (the supply valve 204 and the recovery valve 214) are opened, recycling of ink is started (step S142), a regular operation of the apparatus is started (step S144), and the procedure continues to step S50. Since steps S50 to S56 shown in FIG. 10 are shared with FIG. 8, a description will be hereby omitted.

The ink supplying apparatus 200 according to the second embodiment described above is configured to enable pressure control of the supply flow channel 202 and pressure control of the recovery flow channel 212 to be performed independently. The respective pressure controls can be executed according to a common control flow.

In addition, in the ink supplying apparatus 200 according to the second embodiment, a storage unit for storing a pressure increase value based on a measurement result by the supply flow channel pressure sensor 206 and a storage unit for storing a pressure increase value based on a measurement result by the recovery flow channel pressure sensor 216 may be provided separately or may be shared. Furthermore, a control system for supply and a control system for recovery may be provided separately or may be shared.

According to the ink supplying apparatus 200 according to the second embodiment, even with a recycling ink supplying apparatus, liquid feed speeds of the supply pump 210 and the recovery pump 220 are corrected and a degradation of performances due to individual variances and a degradation over time of the supply pump 210 and the recovery pump 220 are corrected.

Modified Embodiments

Next, an inkjet recording apparatus provided with an inkjet head will be described as a modified embodiment of the ink supplying apparatus described above.

General Configuration of Inkjet Recording Apparatus

Figure 11:
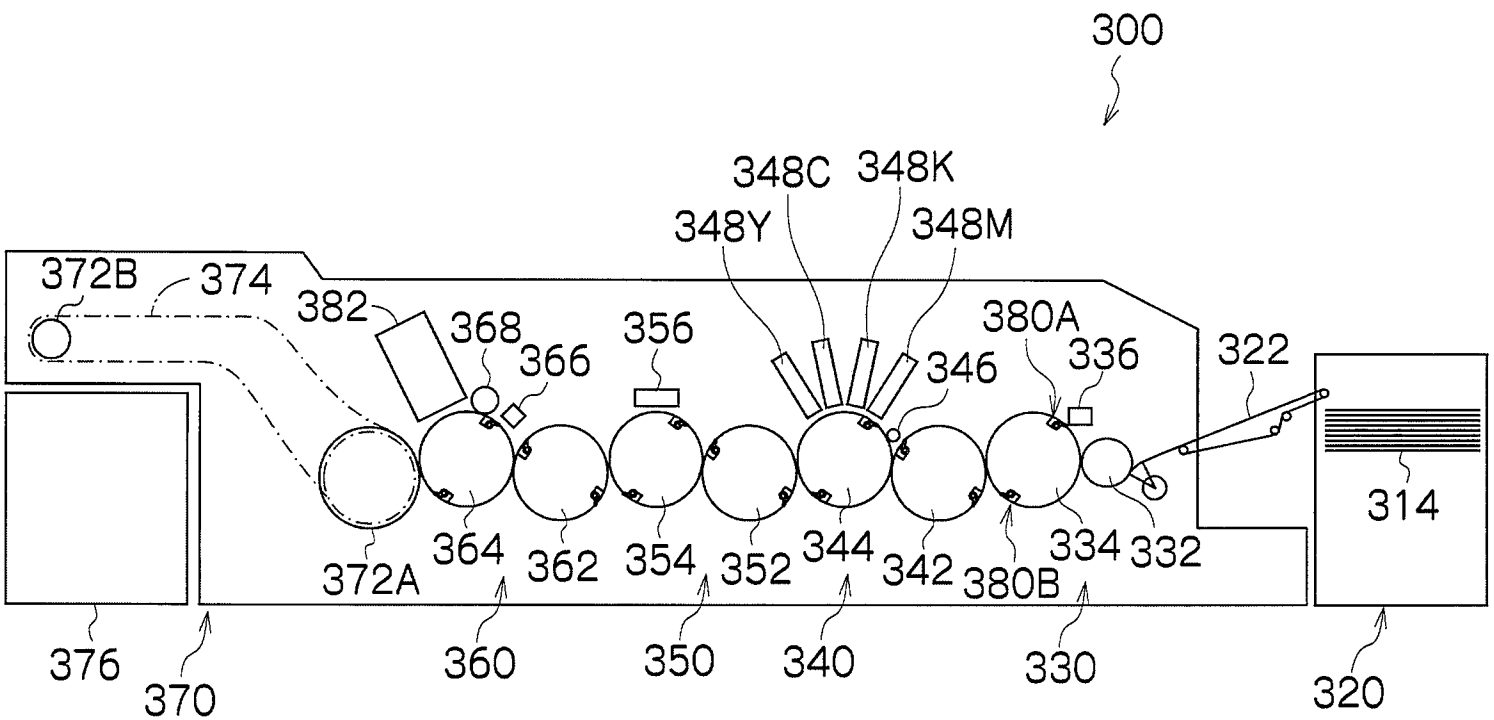
FIG. 11 is a general schematic drawing of an inkjet recording apparatus to which a liquid supplying apparatus according to an embodiment of the present invention is applied.

FIG. 11 is a configuration diagram showing a general configuration of an inkjet recording apparatus including a liquid supplying apparatus according to an embodiment of the present invention. An inkjet recording apparatus 300 shown in FIG. 11 is a recording apparatus which adopts a two-liquid aggregation method in which ink containing a color material and an aggregation treatment liquid which functions to aggregate the ink are used to form an image on a recording surface of a recording medium 314 based on predetermined image data.

The inkjet recording apparatus 300 primarily includes a paper supply unit 320, a treatment liquid application unit 330, a rendering unit 340, a drying unit 350, a fixing unit 360, and a discharging unit 370. In addition, while not shown in FIG. 11, an ink supplying apparatus which supplies ink to the rendering unit 340 is also provided (details of which will be described later).

Transfer cylinders 332, 342, 352, and 362 are respectively provided as devices to deliver the recording medium 314 conveyed to front ends of the treatment liquid application unit 330, the rendering unit 340, the drying unit 350, and the fixing unit 360. In addition, impression cylinders 334, 344, 354, and 364 having drum-like shapes are respectively provided as devices for holding and conveying the recording medium 314 to the treatment liquid application unit 330, the rendering unit 340, the drying unit 350, and the fixing unit 360 respectively.

The transfer cylinders 332 to 362 and the impression cylinders 334 to 364 are each provided with grippers 380A and 380B which sandwich and hold a tip of the recording medium 314 at predetermined positions on outer circumferential surfaces. A structure of the gripper 380A and the gripper 380B for sandwiching and holding a tip of the recording medium 314 and a structure for delivering the recording medium 314 with a gripper provided on another impression cylinder or transfer cylinder are the same. In addition, the gripper 380A and the gripper 380B are arranged at symmetrical positions on an outer circumferential surface of the impression cylinder 334 with respect to a movement of 180 degrees of the impression cylinder 334 in a rotational direction.

When the transfer cylinders 332 to 362 and the impression cylinders 334 to 364 are rotated in a predetermined direction in a state where a tip of the recording medium 314 is sandwiched by the gripper 380A, 380B, the recording medium 314 is rotationally conveyed along outer circumferential surfaces of the transfer cylinders 332 to 362 and the impression cylinders 334 to 364.

Note that, in FIG. 11, only grippers 380A and 380B provided on the impression cylinder 334 are denoted by reference numerals, and that reference numerals have been omitted for grippers of the other impression cylinders and transfer cylinders.

When a recording medium (a sheet of paper) 314 housed in the paper supply unit 320 is supplied to the treatment liquid application unit 330, an aggregation treatment liquid (hereinafter, may also be simply referred to as a "treatment liquid") is applied to a recording surface of the recording medium 314 held on the outer circumferential surface of the impression cylinder 334. Moreover, the "recording surface of the recording medium 314" refers to the outside surface in a state where the recording medium 314 is being held by the impression cylinders 334 to 364 and is a surface opposite to the surface held by the impression cylinders 334 to 364.

Subsequently, the recording medium 314 to which the aggregation treatment liquid has been applied is advanced to the rendering unit 340. At the rendering unit 340, color ink is applied to a region on the recording surface to which the aggregation treatment liquid has been applied, so as to form a desired image.

Furthermore, the recording medium 314 on which the color ink image has been formed is sent to the drying unit 350 where drying is performed on the recording medium 314. After the drying, the recording medium 314 is sent to the fixing unit 360 where fixing is performed on the recording medium 314. By performing drying and fixing, the image formed on the recording medium 314 is hardened. In this manner, a desired image is formed on the recording surface of the recording medium 314. After the image is fixed to the recording surface of the recording medium 314, the recording medium 314 is conveyed from the discharging unit 370 toward outside of the apparatus.

Hereinafter, respective units of the inkjet recording apparatus 300 (the paper supply unit 320, the treatment liquid application unit 330, the rendering unit 340, the drying unit 350, the fixing unit 360, and the discharging unit 370) will be described in detail.

Paper Supply Unit

The paper supply unit 320 is provided with a paper supply tray 322 and an advancing mechanism (not shown), and is configured to advance the recording medium 314 one sheet at a time from the paper supply tray 322. The recording medium 314 advanced from the paper supply tray 322 is positioned by a guiding member (not shown) such that a tip of the recording medium 314 is placed at a position of a gripper (not shown) of the transfer cylinder (paper supply cylinder) 332, and is temporarily stopped. Subsequently, the gripper (not shown) sandwiches the tip of the recording medium 314 and delivers the recording medium 314 with the gripper provided on the transfer cylinder 332.

Treatment Liquid Application Unit

The treatment liquid application unit 330 includes the treatment liquid cylinder (treatment liquid drum) 334 which holds on the outer circumferential surface the recording medium 314 delivered from the paper supply cylinder 332 and conveys the recording medium 314 in a predetermined conveyance direction, and the treatment liquid application unit 336 which applies a treatment liquid on the recording surface of the recording medium 314 held on the outer circumferential surface of the treatment liquid cylinder 334. When the treatment liquid cylinder 334 is rotated counterclockwise as seen in FIG. 11, the recording medium 314 is rotationally conveyed in a counterclockwise direction along the outer circumferential surface of the treatment liquid cylinder 334.

The treatment liquid application unit 336 shown in FIG. 11 is provided at a position opposing the outer circumferential surface (recording medium holding surface) of the treatment liquid cylinder 334. As a configuration example of the treatment liquid application unit 330, a mode is conceivable which includes a treatment liquid container in which a treatment liquid is stored, a pumping roller of which a portion is immersed in the treatment liquid in the treatment liquid container and which pumps up the treatment liquid in the treatment liquid container, and an application roller (rubber roller) which transfers the treatment liquid pumped up by the pumping roller onto the recording medium 314.

Moreover, in a favorable mode, the application roller is configured to include an application roller movement mechanism which moves the application roller in the vertical direction (the normal direction of the outer circumferential surface of the treatment liquid cylinder 334) to prevent the treatment liquid from being applied to portions other than the recording medium 314. In addition, the grippers 380A and 380B which sandwich the tip of the recording medium 314 are arranged not to protrude from the circumferential surface.

The treatment liquid which is applied to the recording medium 314 by the treatment liquid application unit 330 contains a color material aggregating agent which aggregates a color material (pigment) in the ink applied by the rendering unit 340. When the treatment liquid and the ink come into contact with each other on the recording medium 314, separation of the color material and a solvent in the ink is promoted.

The treatment liquid application unit 330 favorably applies the treatment liquid while measuring the amount of treatment liquid applied to the recording medium 314. Favorably, a film thickness of the treatment liquid on the recording medium 314 is sufficiently smaller than a diameter of ink droplets ejected from the rendering unit 340.

Rendering Unit

The rendering unit 340 includes a rendering cylinder (rendering drum) 344 which holds and conveys the recording medium 314, a paper holding roller 346 for bringing the recording medium 314 into close contact with the rendering cylinder 344, and inkjet heads 348M, 348K, 348C, and 348Y which apply inks to the recording medium 314. The rendering cylinder 344 shares a basic structure with the treatment liquid cylinder 334 described earlier.

The paper holding roller 346 is a guiding member for bringing the recording medium 314 into close contact with an outer circumferential surface of the rendering cylinder 344. The paper holding roller 346 opposes the outer circumferential surface of the rendering cylinder 344 and is arranged downstream in a conveyance direction of the recording medium 314 from a delivery position of the recording medium 314 between the transfer cylinder 342 and the rendering cylinder 344, and upstream in the conveyance direction of the recording medium 314 from the inkjet heads 348M, 348K, 348C, and 348Y.

In addition, a paper uplift measurement sensor (not shown) is arranged between the paper holding roller 346 and the inkjet head 348Y furthest upstream in the conveyance direction of the recording medium 314. The paper uplift measurement sensor measures an amount of uplift immediately before the recording medium 314 enters directly beneath the inkjet heads 348M, 348K, 348C, and 348Y. The inkjet recording apparatus 300 according to the present embodiment is configured such that, when an amount of uplift of the recording medium 314 as measured by the paper uplift measurement sensor exceeds a predetermined threshold, a notification of that effect is made and conveyance of the recording medium 314 is suspended.

The recording medium 314 delivered from the transfer cylinder 342 to the rendering cylinder 344 is pressed by the paper holding roller 346 while being rotationally conveyed with the tip of the recording medium 314 sandwiched by the grippers (reference numerals omitted), and comes into close contact with the outer circumferential surface of the rendering cylinder 344. In this manner, after bringing the recording medium 314 into close contact with the outer circumferential surface of the rendering cylinder 344, the recording medium 314 is sent to a print region directly underneath the inkjet heads 348M, 348K, 348C, and 348Y in a state where there is no uplift of the recording medium 314 from the outer circumferential surface of the rendering cylinder 344.

The inkjet heads 348M, 348K, 348C, and 348Y, which respectively correspond to inks of four colors of magenta (M), black (K), cyan (C), and yellow (Y), are arranged in sequence from an upstream side in the rotational direction (the counterclockwise direction as seen in FIG. 11) of the rendering cylinder 344 such that ink ejection surfaces (nozzle surfaces) of the inkjet heads 348M, 348K, 348C, and 348Y oppose the recording surface of the recording medium 314 being held by the rendering cylinder 344. In this case, "ink ejection surfaces (nozzle surfaces)" refer to surfaces of the inkjet heads 348M, 348K, 348C, and 348Y which oppose the recording surface of the recording medium 314 and on which nozzles (shown denoted by reference numeral 408 in FIG. 13) for ejecting ink (to be described later) are formed.

In addition, the inkjet heads 348M, 348K, 348C, and 348Y shown in FIG. 11 are arranged inclined with respect to a horizontal plane such that the recording surface of the recording medium 314 being held by the rendering cylinder 344 and nozzle surfaces of the inkjet heads 348M, 348K, 348C, and 348Y become approximately parallel to each other.

The inkjet heads 348M, 348K, 348C, and 348Y are full line heads having a length corresponding to a maximum width of the image forming region on the recording medium 314 (a length in a direction perpendicular to the conveyance direction of the recording medium 314) and are installed fixed so as to each extend in the direction perpendicular to the conveyance direction of the recording medium 314. In addition, an ink is supplied to each of the inkjet heads 348M, 348K, 348C, and 348Y from an ink supplying apparatus which will be described in detail later.

The nozzles for ejecting ink are formed in a matrix arrangement on the nozzle surface (liquid ejection surface) of the inkjet heads 348M, 348K, 348C, and 348Y, across an entire width of the image forming region on the recording medium 314.

When the recording medium 314 is conveyed to the print region directly underneath the inkjet heads 348M, 348K, 348C, and 348Y, ink droplets of each color are ejected (deposited) from the inkjet heads 348M, 348K, 348C, and 348Y to a region of the recording medium 314 where the aggregation treatment liquid has been applied, according to image data.

When droplets of ink of a corresponding color are ejected from the inkjet heads 348M, 348K, 348C, and 348Y toward the recording surface of the recording medium 314 held on the outer circumferential surface of the rendering cylinder 344, the treatment liquid and the ink come into contact with each other on the recording medium 314, an aggregation reaction of color material dispersed in the ink (pigment-based color material) or insoluble color material (dye-based color material) occurs, and a color material aggregate is formed. Accordingly, movement of color material (displacement of dots, color unevenness of dots) in the image formed on the recording medium 314 is prevented.

In addition, since the rendering cylinder 344 of the rendering unit 340 is structurally separated from the treatment liquid cylinder 334 of the treatment liquid application unit 330, the treatment liquid is prevented from adhering to the inkjet heads 348M, 348K, 348C, and 348Y, and factors which result in an ink ejection abnormality can be reduced.

Moreover, while a configuration of standard colors (four colors) of CMYK has been exemplified in the present embodiment, combinations of ink colors and the number of colors are not limited to the present embodiment and a paler (light color) ink, a deeper ink, or an ink of special color may be added as necessary. For example, a configuration can be adopted in which an inkjet head which ejects a light ink, such as light cyan or light magenta, is added. In addition, arrangement sequences of the respective color heads are not particularly restrictive.

Drying Unit

The drying unit 350 includes a drying cylinder (drying drum) 354 which holds and conveys the recording medium 314 after image formation and a drying apparatus 356 which performs drying to vaporize moisture (liquid component) on the recording medium 314. Since the drying cylinder 354 shares a basic structure with the treatment liquid cylinder 334 and the rendering cylinder 344 described earlier, a description is hereby omitted.

The drying apparatus 356 is arranged at a position opposing an outer circumferential surface of the drying cylinder 354 and is a processing unit for vaporizing moisture existing on the recording medium 314. When the ink is applied to the recording medium 314 by the rendering unit 340, a liquid component (solvent component) of the ink and a liquid component (solvent component) of the treatment liquid which are separated by an aggregation reaction of the treatment liquid and the ink remain on the recording medium 314. Therefore, such liquid components are required to be removed.

The drying apparatus 356 is a processing unit which removes a liquid component existing on the recording medium 314 by performing drying in which the liquid component existing on the recording medium 314 is vaporized by heating with a heater, blowing with a fan, or a combination of both. An amount of heat or an amount of blown air applied to the recording medium 314 is set as appropriate according to parameters such as an amount of moisture remaining on the recording medium 314, a type of the recording medium 314, and a conveyance speed (drying time) of the recording medium 314.

During drying by the drying apparatus 356, since the drying cylinder 354 of the drying unit 350 is structurally separated from the rendering cylinder 344 of the rendering unit 340, factors which may lead to an abnormal ejection of ink due to drying of a head meniscus portion caused by heat or blown air can be reduced at the inkjet heads 348M, 348K, 348C, and 348Y.

In order to take advantage of an effect of correcting cockling of the recording medium 314, a curvature of the drying cylinder 354 is desirably set to 0.002 (1/mm) or greater. In addition, in order to prevent curving (curling) of the recording medium 314 after drying, a curvature of the drying cylinder 354 is desirably set to 0.0033 (1/mm) or smaller.

Furthermore, a device (for example, a built-in heater) for adjusting a surface temperature of the drying cylinder 354 may be included, whereby the surface temperature is desirably adjusted to 50° C. or higher. By applying heating from the rear surface of the recording medium 314, drying is promoted and breakage of an image during a subsequent fixing stage can be prevented. In such a mode, a greater effect can be achieved by providing a device which brings the recording medium 314 into close contact with the outer circumferential surface of the drying cylinder 354. Examples of such a device for bringing the recording medium 314 into close contact include a system based on vacuum adsorption and a system based on electrostatic adsorption.

Moreover, while not particularly restricted, an upper limit of the surface temperature of the drying cylinder 354 is favorably set to 75° C. or lower (more favorably, 60° C. or lower) from the perspective of safety of maintenance work (preventing burns due to a high temperature) such as cleaning ink adhered to the surface of the drying cylinder 354.

As shown, by holding the recording medium 314 on the outer circumferential surface of the drying cylinder 354 so that the recording surface of the recording medium 314 faces outward (in other words, in a state where the recording medium 314 is curved so that the recording surface thereof is a protruding side) and performing drying while rotationally conveying the recording medium 314, drying variances attributable to wrinkles or uplift of the recording medium 314 can be reliably prevented.

Fixing Unit

The fixing unit 360 includes a fixing cylinder (fixing drum) 364 which holds and conveys the recording medium 314, a heater 366 which applies heating to the recording medium 314 on which an image has been formed and from which liquids have been removed, and a fixing roller 368 which presses the recording medium 314 from a side of the recording surface. Since the fixing cylinder 364 shares a basic structure with the treatment liquid cylinder 334, the rendering cylinder 344, and the drying cylinder 354, a description is hereby omitted. The heater 366 and the fixing roller 368 are arranged at positions opposing the outer circumferential surface of the fixing cylinder 364 in sequence from an upstream-side of the rotational direction (a counterclockwise direction as seen in FIG. 11) of the fixing cylinder 364.

At the fixing unit 360, preheating by the heater 366 and fixing by the fixing roller 368 are applied on the recording surface of the recording medium 314. A heating temperature of the heater 366 is set as appropriate according to a recording medium type, an ink type (a type of polymeric microparticles contained in the ink), and the like. For example, a mode can be used in which the glass-transition temperature or the minimum film forming temperature of polymeric microparticles contained in the ink is adopted.

The fixing roller 368 is a roller member which applies heat and pressure to dried ink in order to melt and fix self-dispersible polymeric microparticles in the ink and to transform the ink into a coating, and is configured to heat and pressurize the recording medium 314. Specifically, the fixing roller 368 is arranged so as to be pressed against the fixing cylinder 364, and constitutes a nip roller with the fixing cylinder 364. As a result, the recording medium 314 is sandwiched between the fixing roller 368 and the fixing cylinder 364, nipped under a prescribed nip pressure, and subjected to fixing.

Configuration examples of the fixing roller 368 include a mode in which the fixing roller 368 is configured by a heating roller in which a halogen lamp is incorporated into a metal pipe made from highly heat-conductive aluminum or the like. By heating the recording medium 314 with the heating roller to apply thermal energy equal to or exceeding the glass-transition temperature of the polymeric microparticles contained in the ink, the polymeric microparticles melt to form a transparent coat on a surface of an image.

When the recording surface of the recording medium 314 is pressurized in this state, molten polymeric microparticles are pushed into and fixed to irregularities of the recording medium 314, irregularities of an image surface are leveled, and a favorable gloss can be obtained. Moreover, in another favorable configuration, a plurality of fixing rollers 368 are provided in accordance with a thickness of an image layer and the glass-transition temperature characteristics of the polymeric microparticles.

In addition, favorably, the fixing roller 368 has a surface hardness equal to or lower than 71 in terms of Rubber Hardness Degrees. By softening the surface of the fixing roller 368, an adherence effect to irregularities of the recording medium 314 created by cockling may be expected and uneven fixing attributable to the irregularities of the recording medium 314 can be prevented more effectively.

In the inkjet recording apparatus 300 shown in FIG. 11, an in-line sensor 382 is provided at a subsequent stage (on a downstream-side in the recording medium conveyance direction) of a processing region of the fixing unit 360. The in-line sensor 382 is a sensor which reads an image formed on the recording medium 314 (or a check pattern formed in a margin region of the recording medium 314). A CCD line sensor is favorably used as the in-line sensor 382.

In the inkjet recording apparatus 300 according to the present embodiment, a presence/absence of an ejection abnormality of the inkjet heads 348M, 348K, 348C, and 348Y is determined based on a reading result of the in-line sensor 382. In addition, a mode can also be adopted in which the in-line sensor 382 includes a measuring device which measures a moisture amount, a surface temperature, gloss, and the like. In such a mode, based on a reading result of a moisture amount, a surface temperature, or gloss, parameters such as a drying temperature of the drying unit 350 and a heating temperature and heating pressure of the fixing unit 360 are adjusted as appropriate, and in correspondence with temperature variations inside the apparatus and temperature variations of the respective units, the control parameters described above are adjusted as appropriate.

Discharging Unit

As shown in FIG. 11, the discharging unit 370 is provided subsequent to the fixing unit 360. The discharging unit 370 includes an endless conveying chain 374 wound around tension rollers 372A and 372B, and a discharge tray 376 which houses the recording medium 314 after image formation.

The recording medium 314 after fixing which is advanced by the fixing unit 360 is conveyed by the conveying chain 374 and discharged to the discharge tray 376.

Structure of Inkjet Head

Next, an example of a structure of the inkjet heads 348M, 348K, 348C, and 348Y provided in the rendering unit 340 will be described. Moreover, since the same structure is shared by the inkjet heads 348M, 348K, 348C, and 348Y which correspond to the respective colors, reference numeral 400 will hereinafter representatively denotes an inkjet head (hereinafter, also simply referred to as a "head").

Figure 12:
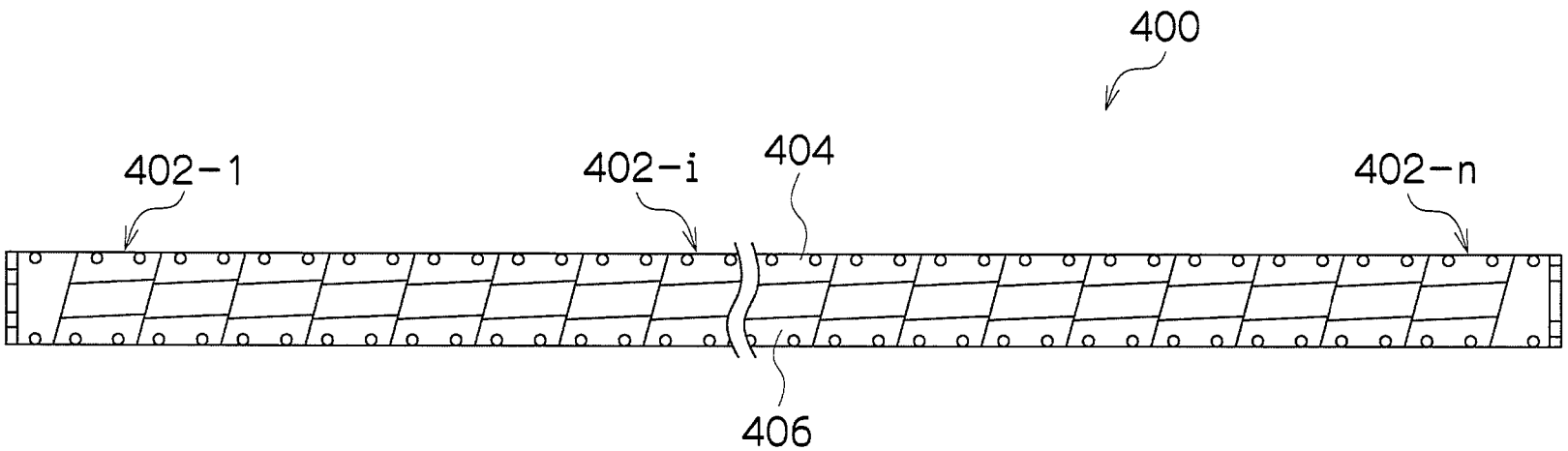
FIG. 12 is a plan transparent view showing a configuration example of an inkjet head mounted onto the inkjet recording apparatus shown in FIG. 11.

FIG. 12 is a schematic configuration diagram of an inkjet head 400 in which a recording surface of a recording medium is viewed from the inkjet head 400 (a plan transparent view of the head). The head 400 shown in FIG. 12 has a multi-head configuration in which n-number of head modules 402-i (where i is an integer between 1 and n) are joined together in single file in a lengthwise direction of the head 400. In addition, each head module 402-i is supported by head covers 404 and 406 from both ends in the breadthways direction of the head 400. Moreover, a multi-head may also be configured by arranging the head modules 402 in a staggered pattern.

Applications of a multi-head configured by a plurality of sub heads include a full line head which corresponds to an entire width of a recording medium. A full line head has a structure in which, with respect to the direction (main scanning direction) perpendicular to the direction (sub-scanning direction) of movement of the recording medium, a plurality of nozzles (shown denoted by reference numeral 408 in FIG. 13) are arranged so as to correspond to the length (width) of the recording medium in the main scanning direction. With a so-called single pass image recording method in which an image is recorded by relatively scanning (moving) the head 400 structured as described above and a recording medium only once, an image may be formed across an entire surface of the recording medium.

Each head module 402-i constituting the head 400 has an approximately parallelogrammatic planar shape, and overlapping portions are provided between adjacent sub-heads. Such an overlapping portion is a joint of sub heads and is formed by nozzles of which adjacent dots belong to different sub-heads with respect to the arrangement direction of the head modules 402-i.

Figure 13:
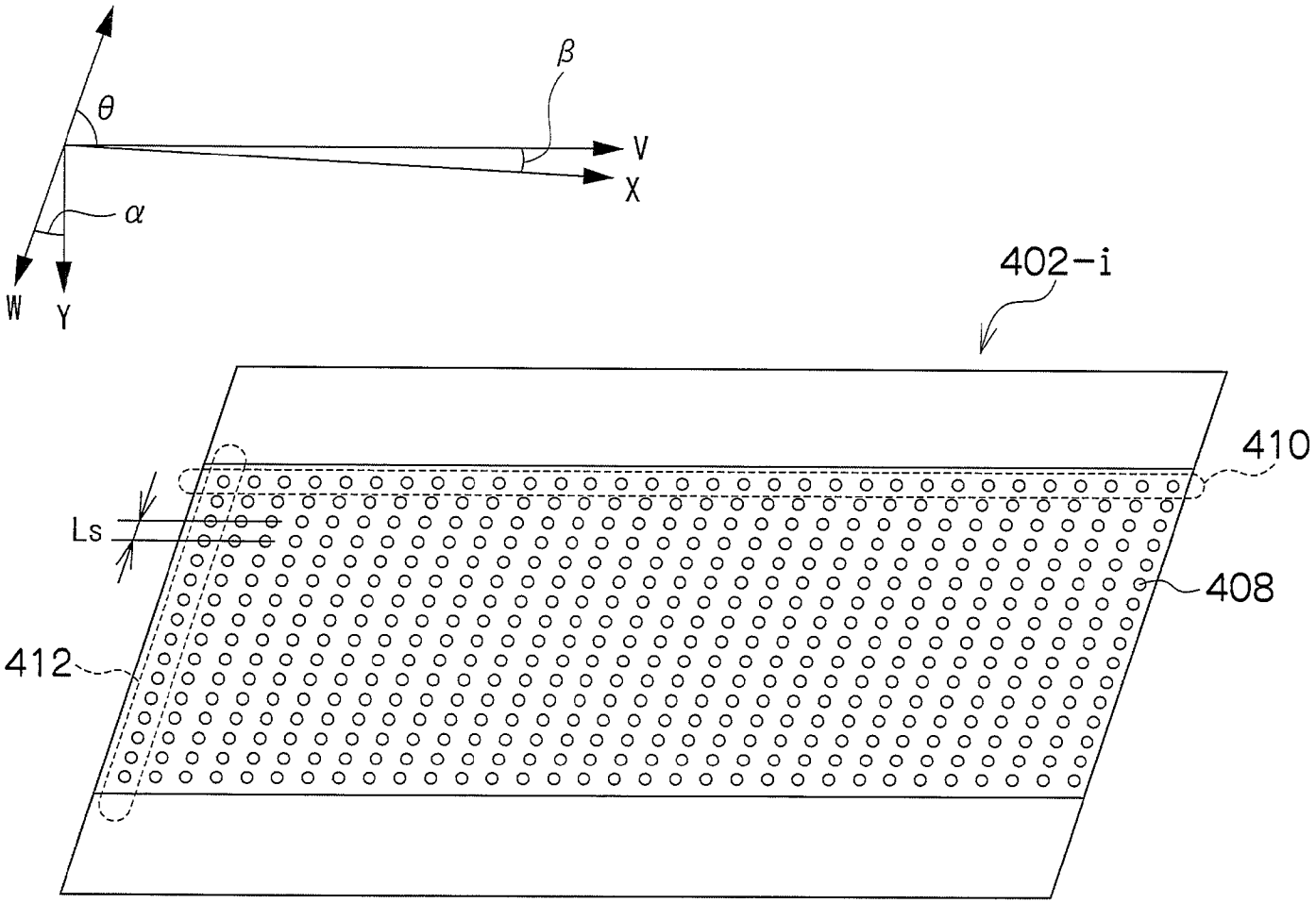
FIG. 13 is a plan view illustrating a nozzle arrangement of the inkjet head shown in FIG. 12.

FIG. 13 is a plan view showing a nozzle arrangement of a head module 402-i. As shown in FIG. 13, each head module 402-i has a structure in which nozzles 408 are arranged in a two-dimensional pattern. A head including this head module 402-i is a so-called matrix head. The head module 402-i shown in FIG. 13 has a structure in which a large number of nozzles 408 are arranged in a column direction W which forms an angle $\alpha$ with respect to the sub-scanning direction Y and a row direction V which forms an angle $\beta$ with respect to the main scanning direction X, and substantially achieves a high nozzle arrangement density in the main scanning direction X. In FIG. 13, a group of nozzles (nozzle row) aligned along the row direction V is shown denoted by reference numeral 410, and a group of nozzles (nozzle column) aligned along the column direction W is shown denoted by reference numeral 412.

Moreover, other examples of the matrix arrangement of the nozzles 408 include a configuration in which a plurality of nozzles 408 are arranged along a row direction which coincides with the main scanning direction X and a column direction which is inclined with respect to the main scanning direction X.

Figure 14:
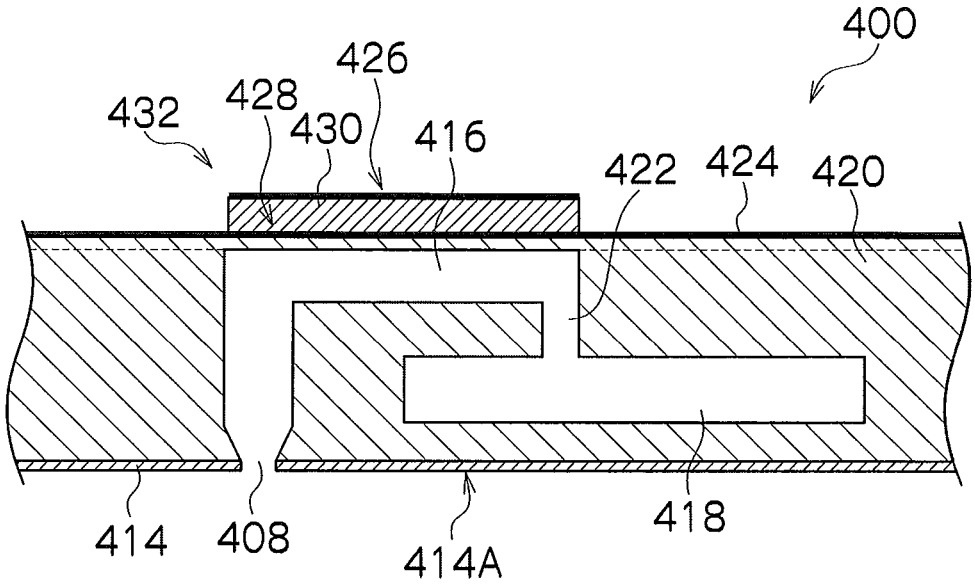
FIG. 14 is a cross-sectional view showing a structure of the inkjet head shown in FIG. 12.

FIG. 14 is a cross-sectional view showing a configuration of a droplet ejection element corresponding to a single channel (an ink chamber unit corresponding to a single nozzle 408) which constitutes a recording element unit. As shown in FIG. 14, the head 400 according to the present embodiment has a structure which laminates and bonds together a nozzle plate 414 in which nozzles 408 are formed, a flow channel plate 420 in which pressure chambers 416 and flow channels such as a common flow channel 418 are formed, and the like. The nozzle plate 414 constitutes a nozzle surface 414A of the head 400. A plurality of nozzles 408 respectively communicated with respective pressure chambers 416 are two-dimensionally formed on the nozzle plate 414.

The flow channel plate 420 is a flow channel forming member which constitutes a side wall part of the pressure chamber 416 and which forms a supply port 422 as a throttle portion (narrowest portion) of an individual supply channel which guides ink from the common flow channel 418 to the pressure chamber 416. Moreover, while a simplified illustration is presented in FIG. 14 for the sake of description, the flow channel plate 420 has a structure in which one or more substrates are laminated.

The nozzle plate 414 and the flow channel plate 420 may be processed into required shapes by a semiconductor manufacturing process using silicon.

The common flow channel 418 communicates with an ink tank (not shown) which is an ink supply source. Ink supplied from the ink tank is supplied to each pressure chamber 416 via the common flow channel 418.

A piezo-actuator 432 which includes an individual electrode 426 and a lower electrode 428 and which has a structure in which a piezoelectric body 430 is sandwiched between the individual electrode 426 and the lower electrode 428 is bonded to a diaphragm 424 which partially constitutes a face (an upper face in FIG. 14) of the pressure chamber 416. When the diaphragm 424 is constituted by a metallic thin film or a metallic oxide film, the diaphragm 424 functions as a common electrode which is equivalent to the lower electrodes 428 of the piezo-actuators 432. Moreover, in a mode where the diaphragm is formed by a nonconductive material such as resin, a lower electrode layer made of a conductive material such as metal is formed on a surface of the diaphragm member.

A drive voltage applied to the individual electrode 426 causes the piezo-actuator 432 to deform and a capacity of the pressure chamber 416 to change, whereby ink is ejected from the nozzle 408 due to a variation in pressure which accompanies the change in capacity. When the piezo-actuator 432 returns to an original state after the ink has been ejected, new ink is supplied from the common flow channel 418 through the supply port 422 to refill the pressure chamber 416.

The high-density nozzle head according to the present embodiment is achieved as shown in FIG. 13 by arranging a large number of ink chamber units structured as described above in a fixed arrangement pattern along the row direction V which forms an angle $\beta$ with respect to the main scanning direction X and the column direction W which forms an angle $\alpha$ with respect to the sub-scanning direction Y. In the matrix arrangement, if Ls denotes spacing between nozzles adjacent in the sub-scanning direction Y, then the nozzles can be handled equivalently to a mode where the nozzles 408 substantially have a linear arrangement with a constant pitch expressed as $P=Ls/\tan\theta$ in the main scanning direction.

While the piezo-actuators 432 are applied in the present embodiment as ejection force generating devices of ink to be ejected from the nozzles 408 provided in the head 400, a thermal method can also be applied in which a heater is provided in a pressure chamber 416 and an ink is ejected using a pressure caused by film boiling due to heating by the heater.

Description of Control System

Figure 15:
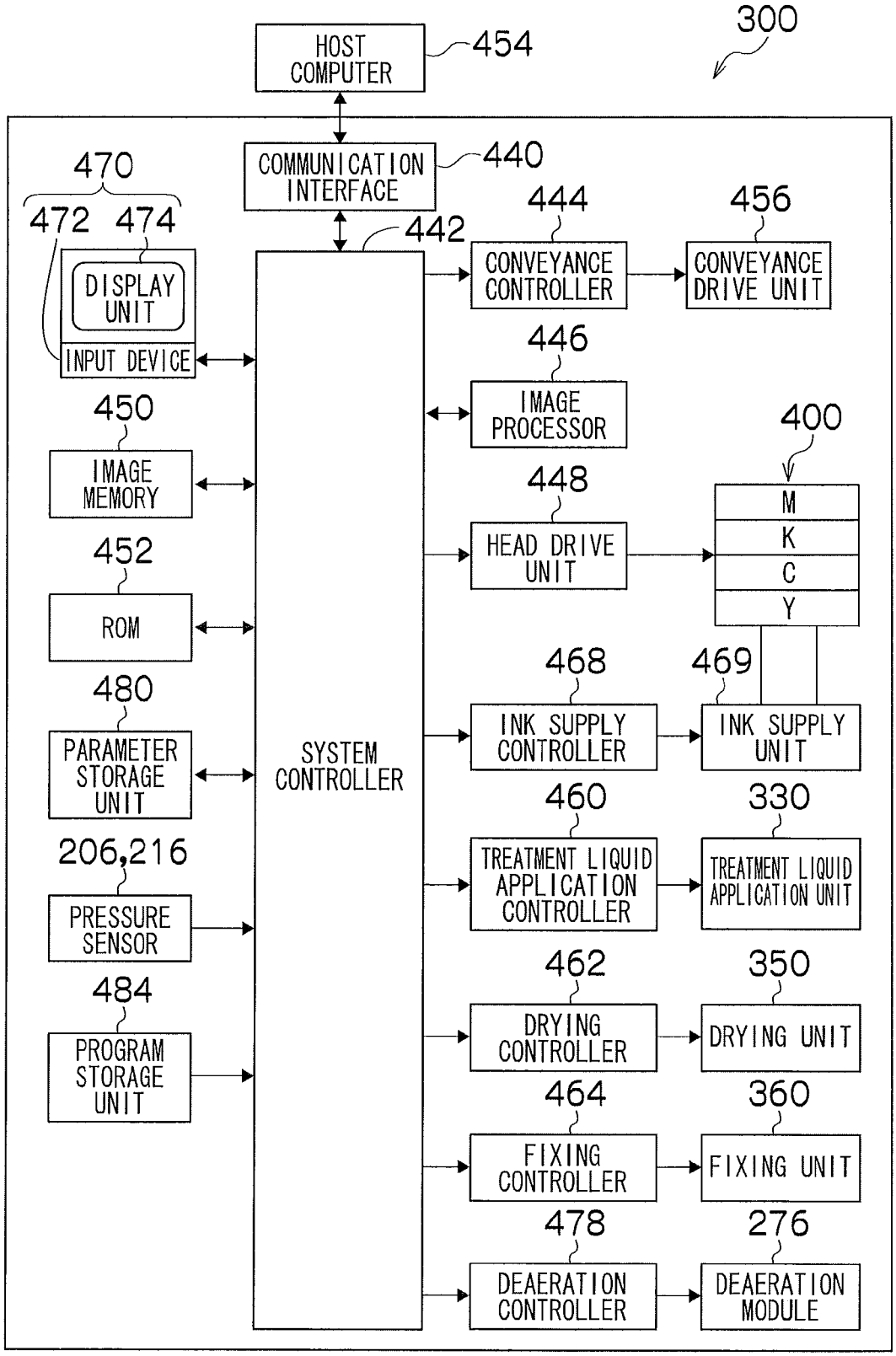
FIG. 15 is a principal block diagram showing a system configuration of the inkjet recording apparatus shown in FIG. 11.

FIG. 15 is a block diagram showing a schematic configuration of a control system of the inkjet recording apparatus 300. The inkjet recording apparatus 300 includes a communication interface 440, a system controller 442, a conveyance controller 444, an image processor 446, and a head drive unit 448, as well as an image memory 450 and a ROM 452.

The communication interface 440 is an interface unit which receives image data sent from a host computer 454. A serial interface such as USB (Universal Serial Bus) or a parallel interface such as Centronix can be applied as the communication interface 440. The communication interface 440 may be mounted with a buffer memory (not shown) for increasing communication speed.

The system controller 442 includes a central processing unit (CPU), peripheral circuitry thereof, and the like, and functions as a control apparatus which controls the entire inkjet recording apparatus 300 according to predetermined programs, as an operational unit which performs various computations, and as a memory controller of the image memory 450 and the ROM 452. In other words, the system controller 442 controls various units such as the communication interface 440 and the conveyance controller 444, controls communication with the host computer 454, controls read/write to/from the image memory 450 and the ROM 452, and also generates control signals for controlling the various units described above.

Image data transmitted from the host computer 454 is received by the inkjet recording apparatus 300 via the communication interface 440 and subjected to predetermined image processing by the image processor 446.

The image processor 446 is a controller having a signal (image) processing function for performing a variety of processing and correction operations for generating print control signals from the image data, and supplies generated printing data to the head drive unit 448. Necessary image processing is performed by the image processor 446. Based on the image data, an ejection amount of droplets (droplet ejection amount) and an ejection timing of the head 400 are controlled via the head drive unit 448. Accordingly, a desired dot size and dot arrangement are realized. Moreover, the head drive unit 448 shown in FIG. 15 may include a feedback control system for maintaining a constant drive condition of the head 400.

The conveyance controller 444 controls a conveyance timing and a conveyance speed of the recording medium 314 (refer to FIG. 11) based on a print control signal generated by the image processor 446. A conveyance drive unit 456 shown in FIG. 15 includes motors for rotating the impression cylinders 334 to 364 and motors for rotating the transfer cylinders 332 to 362 respectively shown in FIG. 11, a motor of an advancing mechanism of the recording medium 314 in the paper supply unit 320, a motor for driving the tension roller 372A (372B) of the discharging unit 370 and the like, and the conveyance controller 444 functions as a driver of the motors described above.

The image memory (primary storage memory) 450 functions as a primary storage device for temporarily storing image data inputted through the communication interface 440, as an expansion area for various programs stored in the ROM 452, and as an operational work area for the CPU (for example, a work area for the image processor 446). A volatile memory capable of sequential read/write (RAM) is used as the image memory 450.

The ROM 452 stores programs which are executed by the CPU of the system controller 442 as well as various data and control parameters necessary for controlling the respective parts of the apparatus. Read/write of data of the ROM 452 is performed via the system controller 442. Besides a memory constituted by a semiconductor element, a magnetic medium such as a hard disk may be used as the ROM 452. In addition, by providing an external interface, an attachable/detachable storage medium may be used.

Furthermore, the inkjet recording apparatus 300 includes a treatment liquid application controller 460, a drying controller 462, and a fixing controller 464 which respectively control operations of the treatment liquid application unit 330, the drying unit 350, and the fixing unit 360 according to instructions from the system controller 442.

The treatment liquid application controller 460 controls a timing of treatment liquid application and a treatment liquid application amount based on print data obtained from the image processor 446. In addition, the drying controller 462 controls a timing of drying as well as a drying temperature and the amount of blown air, and the like, of the drying apparatus 356, while the fixing controller 464 controls a temperature of the heater 366 and pressure applied by the fixing roller 368.

An in-line measuring unit 466 including the in-line sensor 382 shown in FIG. 11 is a processing block which includes a signal processor which performs predetermined required signal processing such as noise reduction, amplification, and waveform shaping on a readout signal outputted from the in-line sensor 382. The system controller 442 determines a presence/absence of an ejection abnormality of the head 400 based on a measurement signal obtained by the in-line measuring unit.

An ink supply controller 468 controls supply of ink to the head 400 by an ink supply unit 469. Specific examples of the ink supply controller 468 include the configuration shown in FIG. 3.

The inkjet recording apparatus 300 according to the present embodiment includes a user interface 470. The user interface 470 includes an input device 472 which is used by an operator (user) to perform various inputs and a display unit (display) 474. Various forms such as a keyboard, a mouse, a touch panel, and a button may be adopted as the input device 472. By operating the input device 472, the operator can input a print condition, select an image quality mode, input and edit supplementary information, search information, and the like. The operator can confirm various information such as an inputted content and a search result through a display of the display unit 474. The display unit 474 also functions as a device for displaying warnings such as an error message. Moreover, the display unit 474 in FIG. 15 can be applied as a display which constitutes a notification device in the control system shown in FIG. 3.

A deaeration controller 478 controls operations of a deaeration module 276 which performs deaeration on liquid sent from the ink tank 102 to the head 400.

A parameter storage unit 480 stores various control parameters necessary for operations of the inkjet recording apparatus 300. The system controller 442 reads out parameters necessary for control as appropriate, and executes updating (rewriting) of the various parameters as required.

The pressure sensors 206 and 216 include a pressure measurement element for measuring pressure in an ink flow channel, and convert measured pressure information into an electric signal and provide the electric signal to the system controller 442. The system controller 442 transmits a command signal to the ink supply controller 468 to cause an operation (rotational speed) of a pump included in the ink supply unit 469 to be corrected based on the pressure information.

A program storage unit 484 is a storage device which stores control programs for operating the inkjet recording apparatus 300. The stored control programs include control programs for the pumps 210 and 220 included in the ink supply unit 469, the deaeration module 276, a heat exchanger 278, and the like.

Specific Example of Ink Supply Unit

Figure 16:
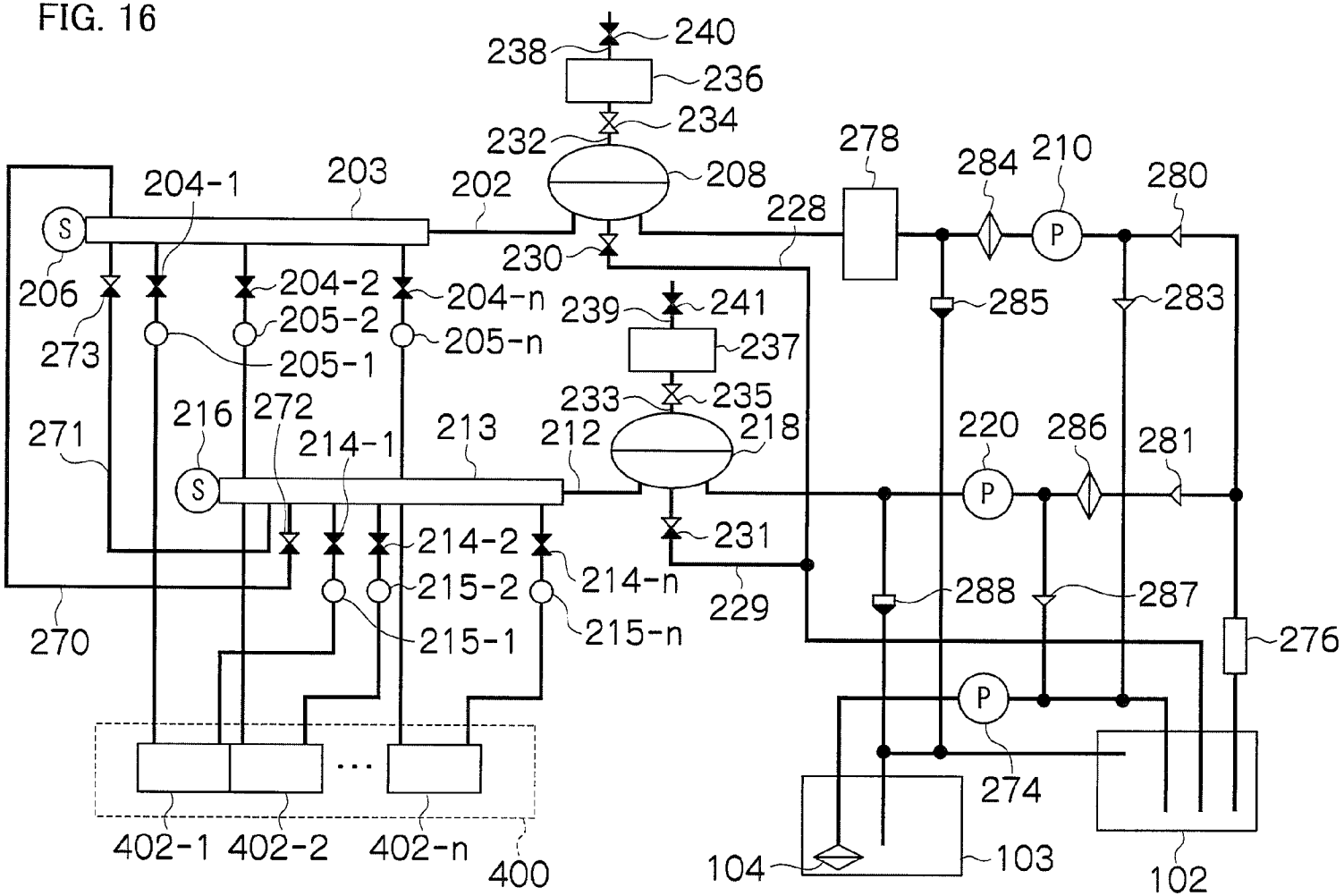
FIG. 16 is a principal block diagram showing a configuration of a recycling ink supplying system applied to the inkjet recording apparatus shown in FIG. 11.

Next, a specific example of the ink supply unit 469 which is applied to the inkjet recording apparatus 300 according to the present embodiment will be described. FIG. 16 is a block diagram showing a schematic configuration of the ink supply unit 469 which supplies ink of colors respectively to the inkjet heads 348M, 348K, 348C, and 348Y shown in FIG. 11.

The recycling ink supply unit 469 shown in FIG. 16 shares a basic configuration with the ink supplying apparatus 200 shown in FIG. 9. The following description will focus on differences between the ink supply unit 469 shown in FIG. 16 and the ink supplying apparatus 200 shown in FIG. 9. Moreover, portions of FIG. 16 that are the same as or similar to portions of FIG. 9 will be denoted by the same reference numerals and a description thereof will be omitted.

The ink supply unit 469 shown in FIG. 16 includes a main tank 103 for replenishing an ink tank 102 with ink. A filter 104 is provided inside the main tank 103, and a replenishment pump 274 is provided in a flow channel via which the ink tank 102 and the main tank 103 communicate with each other. In addition, a deaeration module 276 is provided between the ink tank 102 and a supply pump 210, and ink sent from the ink tank 102 to the supply pump 210 is subjected to deaeration. A flow channel from the deaeration module 276 on a side of the supply pump 210 branches. One flow channel communicates with the supply pump 210 via a one-way valve 280. Another flow channel communicates with a recovery pump 220 via a one-way valve 281.

Furthermore, the channel on an output side of the one-way valve 280 branches, one flow channel communicates with the supply pump 210, and another flow channel communicates with the ink tank 102 via a one-way valve 283.

A heat exchanger 278 is provided between the supply pump 210 and a first pressure absorbing chamber 208, and ink adjusted to a predetermined temperature is sent to the first pressure absorbing chamber 208. A supply flow channel 202 communicates with a supply manifold 203, and a recovery flow channel 212 communicates with a recovery manifold 213. In the ink supply unit 469 shown in FIG. 16, a supply flow channel pressure sensor 206 is provided with the supply manifold 203 and a recovery flow channel pressure sensor 216 is provided with the recovery manifold 213.

The supply manifold 203 and the recovery manifold 213 are connected with each other by a first bypass flow channel 270 and also by a second bypass flow channel 271. A first bypass flow channel valve 272 is provided in the first bypass flow channel 270 and a second bypass flow channel valve 273 is provided in the second bypass flow channel 271.

A head 400 shown in FIG. 16 is constituted by n-number of head modules 402-1 to **402-*n*, and a supply flow channel and a recovery flow channel are provided for each head module 402. An air damper 205 is provided in the supply flow channel provided for each head module 402, and an air damper 215 is provided in the recovery flow channel provided for each head module 402**.

In other words, the supply manifold 203 communicates with the head 400 via the supply valve 204 and the air damper 205, and the recovery manifold 213 communicates with the head 400 via the recovery valve 214 and the air damper 215.

A filter 284 is provided between the supply pump 210 and the heat exchanger 278. The channel branches on a side of the heat exchanger 278 with respect to the filter 284, whereby one flow channel communicates with the heat exchanger 278 and another flow channel communicates with the ink tank 102 and the main tank 103 via a safety valve 285.

Similarly, a filter 286 is provided between the one-way valve 281 and the recovery pump 220. The filter 286 branches on a side of the recovery pump 220, whereby one flow channel communicates with the recovery pump 220 and another flow channel communicates with the ink tank 102 via an one-way valve 287. Furthermore, the channel branches on a side of the second pressure absorbing chamber 218 with respect to the recovery pump 220, whereby one flow channel communicates with the second pressure absorbing chamber 218 and another flow channel communicates with the main tank 103 via a safety valve 288.

In other words, ink sent to the first pressure absorbing chamber 208 is filtered by the filter 284, and ink sent to the second pressure absorbing chamber 218 is filtered by the filter 286. Furthermore, the one-way valves 280, 281, 283, and 287 are provided as appropriate to prevent ink from flowing backwards when the supply pump 210 and the recovery pump 220 are operated in reverse. Moreover, when the safety valves 285 and 288 are operated, feeding of ink to the first pressure absorbing chamber 208 and the second pressure absorbing chamber 218 is suspended.

Furthermore, latched magnetic valves are applied as the drain valves 230 and 231, the first bypass flow channel valve 272, and the second bypass flow channel valve 273, normally-open magnetic valves are applied as the communication valves 234 and 235, and normally-closed magnetic valves are applied as the supply valve 204, the recovery valve 214, and the atmosphere communication valves 240 and 241.

Applications to Other Apparatus Configurations

While an inkjet recording apparatus has been described as an example of an image forming apparatus in the present modified embodiment, an applicable range of the present invention is not limited to applications related to so-called graphic printing such as photoprinting and poster printing, and also encompasses industrial apparatuses capable of forming a pattern that can be recognized as an image such as a resist printing apparatus, a wiring rendering apparatus for an electronic circuit board, and a microstructure forming apparatus.

Appendix

As will be obvious from the detailed description of the embodiments given above, the present specification encompasses disclosures of various technical ideas including aspects of the invention described below.

One aspect of the invention is directed to a liquid supplying apparatus comprising: a first flow channel configured to be switchable between a state of communication with a liquid supply object and a state of noncommunication with the liquid supply object; a first pressure applying device which applies pressure to liquid in the first flow channel; a first pressure absorbing device which absorbs a pressure fluctuation of the liquid in the first flow channel; a first measuring device which measures a pressure increase value in the first flow channel when the first pressure applying device is operated under a standard operating condition in which pressure in the first flow channel varies relatively moderately in proportion to a liquid feed amount to the first flow channel in the state of noncommunication where the liquid supply object and the first flow channel are not communicated with each other; a comparing device which compares the pressure increase value measured by the first measuring device with a predetermined pressure increase target value; and a pressure controlling device which controls the first pressure applying device according to a comparison result of the comparing device so as to correct the pressure applied into the first flow channel.

According to this aspect of the invention, in a liquid supplying apparatus in which a pressure absorbing device for absorbing a pressure fluctuation in a liquid flow channel is provided in the liquid flow channel, a pressure increase of a first flow channel is measured when a first pressure applying device is operated under a standard operation condition in which pressure in the first flow channel varies relatively moderately in proportion to a liquid feed amount to the first flow channel in a state where a liquid supply object and the liquid flow channel are in noncommunication with each other, and pressure applied by the first pressure applying device is corrected based on a measurement result. Therefore, it is possible to discern an isolated performance of the first pressure applying device from which fluctuations such as a flow channel resistance of the liquid supply object have been eliminated, and since an individual variance of the first pressure applying device and a variance due to a change in the first pressure applying device over time are corrected, stable liquid supply is achieved.

Specific examples of the liquid supply object include a liquid ejection head.

Specific examples of switching between the communication with the liquid supply object and the noncommunication with the liquid supply object include a mode in which an opening/closing device for opening/closing the first flow channel is provided in the first flow channel. The opening/closing device is favorably a control valve capable of controlling opening/closing according to a control signal.

Favorably, the first pressure applying device is a pump capable of switching between increasing and reducing the internal pressure of the first flow channel. In other words, pressure of the first flow channel can be increased or reduced by switching rotational directions of the pump so as to switch between ejection and suction.

Desirably, the first pressure absorbing device includes: a first liquid chamber which communicates with the first flow channel; and a first movable part which operates to vary a capacity of the first liquid chamber, and the standard operating condition is an operating condition of the first pressure applying device under which the capacity of the first liquid chamber is varied from a standard capacity to a maximum capacity.

According to this aspect of the invention, in a region where the first liquid chamber included in the first pressure absorbing chamber can vary, a pressure of the first flow channel varies moderately in proportion to a liquid feed amount to the first flow channel. Therefore, the mode is favorable for measuring a pressure increase value.

Desirably, the first pressure absorbing device comprises: a liquid chamber which communicates with the first flow channel; a first movable part which covers at least one surface among surfaces constituting the first liquid chamber and which operates so as to vary a capacity of the first liquid chamber; a first air chamber provided on an opposite side of the first movable part to the first liquid chamber; and a first communication switching device which is provided in the first air chamber and which switches between a state where the first air chamber communicates with atmosphere and a state where the first air chamber is sealed up, and wherein the standard operating condition is an operating condition of the first pressure applying device under which the capacity of the first liquid chamber is varied from a standard capacity to a maximum capacity at which the first movable part comes into contact with an inner wall surface of the first air chamber.

In this aspect, a biasing device which biases the first movable part is favorably provided.

In this aspect, the first movable part favorably includes an elastically-deformable film-like member.

Desirably, the first pressure absorbing device includes a first reserve air chamber configured to be switchable between a state of communication with the first air chamber and a state of noncommunication with the first air chamber.

According to this aspect of the invention, a capacity of the air chamber can be expanded and a wider pressure range can be accommodated.

In this aspect, the reserve air chamber is favorably configured to be capable of communication and noncommunication with atmosphere.

Desirably, the pressure controlling device controls the first pressure applying device to correct the pressure applied into the first flow channel in such a manner that the pressure increase value measured by the first measuring device under the standard operating condition reaches the pressure increase target value.

In this aspect, favorably, a relationship between a liquid feed amount to the first flow channel and pressure of the first flow channel is referenced in order to vary a liquid feed amount to the first flow channel so as to assume the liquid feed amount corresponding to the pressure increase target value.

Desirably, the liquid supplying apparatus further comprises: a storage device which stores a measurement result of the first measuring device; and a notifying device which, when a difference between the pressure increase value measured by the first measuring device and the pressure increase target value does not fall within a predetermined range, issues a notification of that effect, wherein: the comparing device performs a comparison by using as the pressure increase target value the pressure increase value which has been measured by the first measuring device in an initial measurement and stored in the storage device, and the notifying device issues a notification that maintenance of the first pressure applying device is necessary when a difference between the current pressure increase value measured by the first measuring device and the pressure increase target value does not fall within a predetermined range.

According to this aspect of the invention, by comparing the initial pressure increase value with the currently measured pressure increase value, a degradation of the first pressure applying device over time can be discerned, and when a degree of degradation exceeds an allowable range, a notification of that effect is issued. Therefore, maintenance of the first pressure applying device can be performed at an optimal timing.

Desirably, the comparing device performs a comparison by using as the pressure increase target value the previous pressure increase value which has been measured by the first measuring device and stored in the storage device, and the notifying device issues a notification that an abnormality has occurred in the first flow channel when a difference between the current pressure increase value measured by the first measuring device and the pressure increase target value does not fall within a predetermined range.

According to this aspect of the invention, when a significant fluctuation has occurred between the previously measured pressure increase value and the currently measured pressure increase value, it is likely that a leakage or a blockage of the first flow channel has occurred. In this case, by issuing a notification of that effect, maintenance of the first flow channel can be performed.

In this aspect, when a significant increase between the previously measured pressure increase value and the currently measured pressure increase value occurs, it can be judged that a leakage of the first flow channel occurs, and when a significant decrease between the previously measured pressure increase value and the currently measured pressure increase value occurs, it can be judged that a blockage of the first flow channel occurs.

Desirably, the liquid supplying apparatus further comprises: a liquid storage device in which a liquid to be fed to the liquid supply object is stored; a second flow channel which recovers the liquid from the liquid supply object to the liquid storage device; a second pressure absorbing device which absorbs a pressure fluctuation of liquid in the second flow channel; a second pressure applying device which applies pressure into the second flow channel; and a second measuring device which measures a pressure increase value in the second flow channel when the second pressure applying device is operated under a standard operating condition in which pressure in the second flow channel varies relatively moderately in proportion to a liquid feed amount to the second flow channel in a state of noncommunication where the liquid supply object and the second flow channel are not communicated with each other, wherein: the comparing device compares the pressure increase value measured by the second measuring device, with a predetermined pressure increase target value; and the pressure controlling device controls the second pressure applying device according to the comparison result of the comparing device so as to correct the pressure applied into the second flow channel.

According to this aspect of the invention, in a recycling liquid supplying apparatus including a supplying flow channel (first flow channel) of liquid supplied to a liquid supply object and a recovering flow channel (second flow channel) which recycles liquid from the liquid supply object, pressure fluctuation of the second flow channel attributable to the second pressure applying device which applies pressure to the second flow channel is corrected. Therefore, favorable liquid recycling is realized.

In this aspect, the same configuration can be applied as the first pressure measuring device and the second pressure measuring device. In addition, the same configuration can also be applied as the first pressure applying device and the second pressure applying device.

A mode may be adopted in which the comparing device includes a first comparing device which performs a comparison based on a measurement result of the first measuring device and a second comparing device which performs a comparison based on a measurement result of the second measuring device.

A mode may be adopted in which the pressure controlling device includes a first pressure controlling device which controls the first pressure applying device and a second pressure controlling device which controls the second pressure applying device.

Desirably, the liquid supplying apparatus further comprises: a bypass flow channel via which the first flow channel and the second flow channel communicate with each other; and a bypass flow channel opening/closing switching device which is provided in the bypass flow channel and which switches between opening and closing of the bypass flow channel, wherein the pressure controlling device controls the first pressure applying device according to the pressure increase value in the first flow channel measured by the first measuring device in a state where the bypass flow channel is closed.

According to this aspect of the invention, favorable correction of the first pressure applying device is realized from which pressure fluctuating elements attributable to the bypass flow channel such as a flow channel resistance of the bypass flow channel have been eliminated.

Desirably, the pressure controlling device controls the second pressure applying device according to the pressure increase value in the second flow channel measured by the second measuring device in a state where the bypass flow channel is closed.

According to this aspect of the invention, favorable correction of the second pressure applying device is realized from which pressure fluctuating elements attributable to the bypass flow channel such as a flow channel resistance of the bypass flow channel have been eliminated.

Desirably, the second pressure absorbing device includes: a second liquid chamber which communicates with the second flow channel; and a second movable part which operates to vary a capacity of the second liquid chamber, and the standard operating condition is an operating condition of the second pressure applying device in a period of change of the capacity of the second liquid chamber from a standard capacity to a maximum capacity.

Desirably, the second pressure absorbing device includes: a second liquid chamber which communicates with the second flow channel; a second movable part which covers at least one surface among surfaces constituting the second liquid chamber and which operates so as to vary a capacity of the second liquid chamber; a second air chamber provided on an opposite side of the second movable part to the second liquid chamber; and a second communication switching device which is provided in the second air chamber and which switches between a state where the second air chamber communicates with atmosphere and a state where the second air chamber is sealed up, and the standard operating condition is an operating condition of the second pressure applying device in a period of change of the capacity of the second liquid chamber varies from a standard capacity to a maximum capacity at which the second movable part comes into contact with an inner wall surface of the second air chamber.

Desirably, the second pressure absorbing device includes a second reserve air chamber configured to be switchable between a state of communication with the second air chamber and a state of noncommunication with the second air chamber.

Desirably, the pressure controlling device controls the second pressure applying device so as to cause the pressure increase value measured by the second measuring device under the standard operating condition to assume the pressure increase target value in such a manner that the liquid feed amount to the second flow channel is corrected.

Desirably, a measurement result of the second measuring device is stored in a storage device stores, the comparing device performs a comparison by using as the pressure increase target value an initial pressure increase value which has been measured by the second measuring device and stored in the storage device, and the notifying device issues a notification that maintenance of the second pressure applying device is necessary when a difference between the current pressure increase value measured by the second measuring device and the pressure increase target value does not fall within a predetermined range.

Desirably, the comparing device performs a comparison by using as the pressure increase target value the previous pressure increase value which has been measured by the second measuring device and stored in the storage device, and the notifying device issues a notification that an abnormality has occurred in the second flow channel when a difference between the current pressure increase value measured by the second measuring device and the pressure increase target value does not fall within a predetermined range.

Another aspect of the invention is directed to a liquid ejecting apparatus comprising: a liquid ejecting device which ejects liquid; and a liquid supplying apparatus for supplying the liquid to the liquid ejecting device, the liquid supplying apparatus including: a first flow channel configured to be switchable between a state of communication with the liquid ejecting device and a state of noncommunication with the liquid ejecting device; a first pressure applying device which applies pressure to liquid in the first flow channel; a first pressure absorbing device which absorbs a pressure fluctuation of the liquid in the first flow channel; a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other; a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel.

Liquid ejecting apparatuses according to the present invention include an inkjet recording apparatus having an inkjet head.

Desirably, the first measuring device measures the pressure increase value at least before a regular operation of the liquid ejecting apparatus.

According to this aspect of the invention, a measurement of the pressure increase can also be performed during an idle period of the apparatus or the like.

Desirably, the liquid supplying apparatus includes the liquid supplying apparatus.

Desirably, the liquid ejecting apparatus further comprises a liquid storage device in which the liquid to be fed to the liquid ejecting device is stored, wherein the liquid supplying apparatus includes: a second flow channel which recovers the liquid from the liquid ejecting device to the liquid storage device; a second pressure absorbing device which absorbs a pressure fluctuation of the liquid in the second flow channel; a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, and wherein the pressure controlling device controls the second pressure applying device according to a comparison result of the comparing device so as to correct the pressure applied into the second flow channel.

According to this aspect of the invention, in a liquid ejecting apparatus including a recycling liquid supplying apparatus which includes a supply flow channel which supplies liquid to a liquid ejecting device and a recovery flow channel which recycles liquid from the liquid ejecting device, favorable pressure correction is realized.

Desirably, the second measuring device measures the pressure increase value at least before a regular operation of the liquid ejecting apparatus.

Desirably, the liquid supplying apparatus includes the liquid supplying apparatus.

Another aspect of the invention is directed to a pressure control method comprising: a first pressure applying step of applying pressure into a first flow channel configured to be switchable between a state of communication with a liquid supply object and a state of noncommunication with the liquid supply object; a first pressure absorbing step of absorbing a pressure fluctuation of liquid in the first flow channel; a first measuring step of, in a state where the liquid supply object and the first flow channel are in a state of noncommunication with each other, applying the pressure into the first flow channel under a standard operating condition in which pressure in the first flow channel varies relatively moderately in proportion to a liquid feed amount to the first flow channel and measuring a pressure increase value in the first flow channel; a comparison step of comparing the pressure increase value measured in the first measuring step with a predetermined pressure increase target value; and a pressure control step of controlling pressure according to a comparison result in the comparing step so as to correct the pressure applied into the first flow channel.

Modes are also possible which include processes corresponding to respective devices in the liquid supplying apparatus.

Desirably, the pressure control method further comprises: a recovering step of recovering liquid from the liquid supply object via a second flow channel; a second pressure absorbing step of absorbing a pressure fluctuation of liquid in the second flow channel; a second pressure applying step of applying pressure into the second flow channel; and a second measuring step of, in a state where the liquid supply object and the second flow channel are in a state of noncommunication with each other, measuring a pressure increase value in the second flow channel when the second pressure applying step is executed under a standard operating condition in which pressure in the second flow channel varies relatively moderately in proportion to a liquid feed amount to the second flow channel, wherein: in the comparison step, the pressure increase value measured in the second measuring step is compared with a predetermined pressure increase target value; and in the pressure controlling step, pressure is controlled according to a comparison result in the comparing step so as to correct the pressure applied into the second flow channel.

Modes are also possible which include processes corresponding to respective devices in the liquid supplying apparatus.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supplying apparatus comprising:

a first flow channel configured to be switchable between a state of communication with a liquid supply object and a state of noncommunication with the liquid supply object;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in the state of noncommunication where the liquid supply object and the first flow channel are not communicated with each other;

a comparing device which compares the pressure increase value measured by the first measuring device with a predetermined pressure increase target value; and a pressure controlling device which controls the first pressure applying device according to a comparison result of the comparing device so as to correct the pressure applied into the first flow channel;

wherein the first pressure absorbing device includes:

a liquid chamber which communicates with the first flow channel;

a first movable part which covers at least one surface among surfaces constituting the first liquid chamber and which operates so as to vary a capacity of the first liquid chamber;

a first air chamber provided on an opposite side of the first movable part to the first liquid chamber; and a first communication switching device which is provided in the first air chamber and which switches between a state where the first air chamber communicates with atmosphere and a state where the first air chamber is sealed up, wherein the standard operating condition is an operating condition of the first pressure applying device under which the capacity of the first liquid chamber is varied from a standard capacity to a maximum capacity at which the first movable part comes into contact with an inner wall surface of the first air chamber; and wherein the first pressure absorbing device includes a first reserve air chamber configured to be switchable between a state of communication with the first air chamber and a state of noncommunication with the first air chamber.

2. The liquid supplying apparatus as defined in claim 1, wherein the pressure controlling device controls the first pressure applying device to correct the pressure applied into the first flow channel in such a manner that the pressure increase value measured by the first measuring device under the standard operating condition reaches the pressure increase target value.

3. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, wherein the liquid supplying apparatus includes the liquid supplying apparatus as defined in claim 2.

4. The liquid supplying apparatus as defined in claim 1, further comprising:

a storage device which stores a measurement result of the first measuring device; and a notifying device which, when a difference between the pressure increase value measured by the first measuring device and the pressure increase target value does not fall within a predetermined range, issues a notification of that effect, wherein:

the comparing device performs a comparison by using as the pressure increase target value the pressure increase value which has been measured by the first measuring device in an initial measurement and stored in the storage device, and the notifying device issues a notification that maintenance of the first pressure applying device is necessary when a difference between the current pressure increase value measured by the first measuring device and the pressure increase target value does not fall within a predetermined range.

5. The liquid supplying apparatus as defined in claim 4, wherein:

the comparing device performs a comparison by using as the pressure increase target value the previous pressure increase value which has been measured by the first measuring device and stored in the storage device, and the notifying device issues a notification that an abnormality has occurred in the first flow channel when a difference between the current pressure increase value measured by the first measuring device and the pressure increase target value does not fall within a predetermined range.

6. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, wherein the liquid supplying apparatus includes the liquid supplying apparatus as defined in claim 4.

7. The liquid supplying apparatus as defined in claim 1, further comprising:

a liquid storage device in which a liquid to be fed to the liquid supply object is stored;

a second flow channel which recovers the liquid from the liquid supply object to the liquid storage device;

a second pressure absorbing device which absorbs a pressure fluctuation of liquid in the second flow channel;

a second pressure applying device which applies pressure into the second flow channel; and a second measuring device which measures a pressure increase value in the second flow channel when the second pressure applying device is operated under a standard operating condition in which pressure in the second flow channel varies relatively moderately in proportion to a liquid feed amount to the second flow channel in a state of noncommunication where the liquid supply object and the second flow channel are not communicated with each other, wherein:

the comparing device compares the pressure increase value measured by the second measuring device, with a predetermined pressure increase target value; and the pressure controlling device controls the second pressure applying device according to the comparison result of the comparing device so as to correct the pressure applied into the second flow channel.

8. The liquid supplying apparatus as defined in claim 7, further comprising:

a bypass flow channel via which the first flow channel and the second flow channel communicate with each other; and a bypass flow channel opening/closing switching device which is provided in the bypass flow channel and which switches between opening and closing of the bypass flow channel, wherein the pressure controlling device controls the first pressure applying device according to the pressure increase value in the first flow channel measured by the first measuring device in a state where the bypass flow channel is closed.

9. The liquid supplying apparatus as defined in claim 8, wherein the pressure controlling device controls the second pressure applying device according to the pressure increase value in the second flow channel measured by the second measuring device in a state where the bypass flow channel is closed.

10. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, wherein the pressure controlling device controls the second pressure applying device according to a comparison result of the comparing device so as to correct the pressure applied into the second flow channel, and wherein the liquid supplying apparatus includes the liquid supplying apparatus as defined in claim 8.

11. The liquid supplying apparatus as defined in claim 7, wherein:

the second pressure absorbing device includes:

a second liquid chamber which communicates with the second flow channel; and a second movable part which operates to vary a capacity of the second liquid chamber, and the standard operating condition is an operating condition of the second pressure applying device in a period of change of the capacity of the second liquid chamber from a standard capacity to a maximum capacity.

12. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, wherein the pressure controlling device controls the second pressure applying device according to a comparison result of the comparing device so as to correct the pressure applied into the second flow channel and, wherein the liquid supplying apparatus includes the liquid supplying apparatus as defined in claim 11.

13. The liquid supplying apparatus as defined in claim 7, wherein:

the second pressure absorbing device includes:

a second liquid chamber which communicates with the second flow channel;

a second movable part which covers at least one surface among surfaces constituting the second liquid chamber and which operates so as to vary a capacity of the second liquid chamber;

a second air chamber provided on an opposite side of the second movable part to the second liquid chamber; and a second communication switching device which is provided in the second air chamber and which switches between a state where the second air chamber communicates with atmosphere and a state where the second air chamber is sealed up, and the standard operating condition is an operating condition of the second pressure applying device in a period of change of the capacity of the second liquid chamber varies from a standard capacity to a maximum capacity at which the second movable part comes into contact with an inner wall surface of the second air chamber.

14. The liquid supplying apparatus as defined in claim 13, wherein the second pressure absorbing device includes a second reserve air chamber configured to be switchable between a state of communication with the second air chamber and a state of noncommunication with the second air chamber.

15. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, wherein the pressure controlling device controls the second pressure applying device according to a comparison result of the comparing device so as to correct the pressure applied into the second flow channel and, wherein the liquid supplying apparatus includes the liquid supplying apparatus as defined in claim 13.

16. The liquid supplying apparatus as defined in claim 7, wherein the pressure controlling device controls the second pressure applying device so as to cause the pressure increase value measured by the second measuring device under the standard operating condition to assume the pressure increase target value in such a manner that the liquid feed amount to the second flow channel is corrected.

17. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, wherein the pressure controlling device controls the second pressure applying device according to a comparison result of the comparing device so as to correct the pressure applied into the second flow channel and, wherein the liquid supplying apparatus includes the liquid supplying apparatus as defined in claim 16.

18. The liquid supplying apparatus as defined in claim 7, wherein:

a measurement result of the second measuring device is stored in a storage device stores, the comparing device performs a comparison by using as the pressure increase target value an initial pressure increase value which has been measured by the second measuring device and stored in the storage device, and the notifying device issues a notification that maintenance of the second pressure applying device is necessary when a difference between the current pressure increase value measured by the second measuring device and the pressure increase target value does not fall within a predetermined range.

19. The liquid supplying apparatus as defined in claim 18, wherein:

the comparing device performs a comparison by using as the pressure increase target value the previous pressure increase value which has been measured by the second measuring device and stored in the storage device, and the notifying device issues a notification that an abnormality has occurred in the second flow channel when a difference between the current pressure increase value measured by the second measuring device and the pressure increase target value does not fall within a predetermined range.

20. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, wherein the pressure controlling device controls the second pressure applying device according to a comparison result of the comparing device so as to correct the pressure applied into the second flow channel and, wherein the liquid supplying apparatus includes the liquid supplying apparatus as defined in claim 18.

21. A liquid ejecting apparatus comprising:

a liquid ejecting device which ejects liquid; and a liquid supplying apparatus for supplying the liquid to the liquid ejecting device, the liquid supplying apparatus including:

a first flow channel configured to be switchable between a state of communication with the liquid ejecting device and a state of noncommunication with the liquid ejecting device;

a first pressure applying device which applies pressure to liquid in the first flow channel;

a first pressure absorbing device which absorbs a pressure fluctuation of the liquid in the first flow channel;

a first measuring device which measures a pressure increase value in the first flow channel when the first pressure applying device is operated under a standard operating condition in which pressure in the first flow channel varies relatively moderately in proportion to a liquid feed amount to the first flow channel in a state where a liquid supply object and the first flow channel are in a state of noncommunication with each other;

a comparing device which compares the pressure increase value measured by the first measuring device with a predetermined pressure increase target value; and a pressure controlling device which controls the first pressure applying device according to a comparison result of the comparing device so as to correct the pressure to be applied into the first flow channel;

wherein the first pressure absorbing device includes:

a liquid chamber which communicates with the first flow channel;

a first movable part which covers at least one surface among surfaces constituting the first liquid chamber and which operates so as to vary a capacity of the first liquid chamber;

a first air chamber provided on an opposite side of the first movable part to the first liquid chamber; and a first communication switching device which is provided in the first air chamber and which switches between a state where the first air chamber communicates with atmosphere and a state where the first air chamber is sealed up, wherein the standard operating condition is an operating condition of the first pressure applying device under which the capacity of the first liquid chamber is varied from a standard capacity to a maximum capacity at which the first movable part comes into contact with an inner wall surface of the first air chamber; and wherein the first pressure absorbing device includes a first reserve air chamber configured to be switchable between a state of communication with the first air chamber and a state of noncommunication with the first air chamber.

22. The liquid ejecting apparatus as defined in claim 21, wherein the first measuring device measures the pressure increase value at least before a regular operation of the liquid ejecting apparatus.

23. The liquid ejecting apparatus as defined in claim 21, further comprising a liquid storage device in which the liquid to be fed to the liquid ejecting device is stored, wherein the liquid supplying apparatus includes:

a second flow channel which recovers the liquid from the liquid ejecting device to the liquid storage device;

a second pressure absorbing device which absorbs a pressure fluctuation of the liquid in the second flow channel;

a second pressure applying device which applies pressure into the second flow channel; and a second measuring device which measures a pressure increase value in the second flow channel when the second pressure applying device is operated under a standard operating condition in which the pressure in the second flow channel varies relatively moderately in proportion to a liquid feed amount to the second flow channel in a state where the liquid supply object and the second flow channel are in a state of noncommunication with each other, wherein the comparing device compares the pressure increase value measured by the second measuring device with a predetermined pressure increase target value, and wherein the pressure controlling device controls the second pressure applying device according to a comparison result of the comparing device so as to correct the pressure applied into the second flow channel.

24. The liquid ejecting apparatus as defined in claim 23, wherein the second measuring device measures the pressure increase value at least before a regular operation of the liquid ejecting apparatus.

* * * * *